US011738833B1

(12) United States Patent
Morin-Savard et al.

(10) Patent No.: US 11,738,833 B1
(45) Date of Patent: Aug. 29, 2023

(54) FENDER SYSTEM FOR A WATERCRAFT

(71) Applicant: BOMBARDIER RECREATIONAL PRODUCTS INC., Valcourt (CA)

(72) Inventors: Alexandre Morin-Savard, Sherbrooke (CA); Mathieu Mercier, Sherbrooke (CA); Bart Van Den Bogaard, Racine (CA); Mohammad Moeini, Sherbrooke (CA); Karl Dery St-Cyr, St-Denis de Brompton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 122 days.

(21) Appl. No.: 17/219,568

(22) Filed: Mar. 31, 2021

Related U.S. Application Data

(60) Provisional application No. 63/002,826, filed on Mar. 31, 2020.

(51) Int. Cl.
*B63B 59/02* (2006.01)
*B63B 34/10* (2020.01)

(52) U.S. Cl.
CPC ..... *B63B 59/02* (2013.01); *B63B 34/10* (2020.02)

(58) Field of Classification Search
CPC ..... B63B 59/00; B63B 59/02; B63B 34/10; B63B 21/00; B63B 21/04
USPC ..... 114/219, 220
See application file for complete search history.

(56) References Cited

U.S. PATENT DOCUMENTS 4,893,576 A 1/1990 Day et al.
5,152,245 A 10/1992 Olsen
5,220,879 A 6/1993 Johnson
5,299,521 A 4/1994 Loucks
5,832,857 A 11/1998 McPherson
6,021,729 A 2/2000 DeRuscio
6,289,835 B1 9/2001 Silberman
(Continued)

FOREIGN PATENT DOCUMENTS

EP 0827904 A2 3/1998
EP 987176 A2 3/2000
(Continued)

OTHER PUBLICATIONS

Taylor Made Products, Neon Green Super Gard™ Fenders by Taylor Made Products, Youtube Video uploaded on Feb. 6, 2018, https://youtu.be/rg8T2xV-Ddk?t=13.

*Primary Examiner* — Lars A Olson
(74) *Attorney, Agent, or Firm* — BCF LLP

(57) ABSTRACT

A fender system for a watercraf includes: a fender body defining an insertion recess in a peripheral surface of the fender body; a first connecting feature disposed at least in part in the insertion recess of the fender body; and a connecting base configured to be connected to the watercraft. The connecting base includes a second connecting feature. The first connecting feature is configured to engage the second connecting feature for stowing the fender body on the watercraft. It is also contemplated that a fender system for a watercraft includes: a fender body defining an insertion recess in a peripheral surface of the fender body; and a first connecting feature disposed at least in part in the insertion recess of the fender body. The first connecting feature is configured to engage a second connecting feature disposed on a part of the watercraft for stowing the fender body on the watercraft.

21 Claims, 19 Drawing Sheets

(56) References Cited

U.S. PATENT DOCUMENTS

| | | | | |
|---|---|---|---|---|
| 6,332,421 | B1 | 12/2001 | Leonard et al. | |
| 6,357,377 | B1 | 3/2002 | Santelli | |
| 6,477,973 | B1 | 11/2002 | Kobas | |
| 6,534,212 | B1 | 3/2003 | Hooke et al. | |
| 6,752,098 | B2 | 6/2004 | Skulnick | |
| 6,758,156 | B1 | 7/2004 | Kobas | |
| 6,951,181 | B1 * | 10/2005 | Lemke | B63B 59/02 114/219 |
| 6,983,711 | B1 | 1/2006 | Lemke | |
| 7,080,606 | B1 | 7/2006 | Harrison | |
| 7,293,518 | B1 | 11/2007 | Gassew | |
| 9,365,268 | B1 | 6/2016 | Paccoud et al. | |
| 9,789,937 | B1 | 10/2017 | Ratigan | |
| 2003/0217684 | A1 | 11/2003 | Chaffee et al. | |
| 2004/0107887 | A1 | 6/2004 | Kinkead | |
| 2010/0031862 | A1 | 2/2010 | Powell et al. | |

FOREIGN PATENT DOCUMENTS

| | | | |
|---|---|---|---|
| GB | 2388078 | A | 11/2003 |
| GB | 2435014 | A | 8/2007 |
| JP | H11301588 | A | 11/1999 |
| JP | H11348880 | A | 12/1999 |
| JP | 4331691 | B2 | 9/2009 |
| JP | 5039085 | B2 | 10/2012 |
| WO | 2004076749 | A1 | 9/2004 |

* cited by examiner

FENDER SYSTEM FOR A WATERCRAFT

CROSS-REFERENCE

The present application claims priority from U.S. Provisional Patent Application No. 63/002,826, filed on Mar. 31, 2020, the entirety of which is incorporated by reference herein.

FIELD OF TECHNOLOGY

The present technology relates to fender systems for watercraft.

BACKGROUND

Some watercraft such as pontoon boats employ fenders to protect the watercraft from impacts with obstacles such as a dock. In particular, such fenders are typically hung from a side or sides of a watercraft so that, when the watercraft gets close to a dock, for example, the fenders will be disposed between the watercraft and the dock to prevent damage to the hull and/or other outer surfaces of the watercraft. Once the watercraft is under way and no longer near an obstacle, the fenders are typically stowed away on the watercraft for future use.

However, stowing the fenders on the watercraft can be impractical as the fenders occupy space on the watercraft and, in some cases, if no particular storage location is provided on the watercraft (e.g., a rack or storage box), they are sometimes strewn about on the deck which creates clutter for the occupant(s) of the watercraft. In addition, it can also be time-consuming to attach and detach the fenders to the watercraft each time the fenders are deployed or stowed away.

In view of the foregoing, there is a need for a fender system for a watercraft that addresses at least some of these drawbacks.

SUMMARY

It is an object of the present technology to ameliorate at least some of the inconveniences present in the prior art.

According to an aspect of the present technology, there is provided a fender system for a watercraft. The fender system includes: a fender body defining an insertion recess in a peripheral surface of the fender body; a first connecting feature disposed at least in part in the insertion recess of the fender body; and a connecting base configured to be connected to the watercraft, the connecting base comprising a second connecting feature, the first connecting feature being configured to engage the second connecting feature for stowing the fender body on the watercraft.

In some embodiments, one of the first connecting feature and the second connecting feature is a male connecting feature, and an other one of the first connecting feature and the second connecting feature is a female connecting feature configured to receive at least part of the male connecting feature therein.

In some embodiments, the first connecting feature is the male connecting feature, and the second connecting feature is the female connecting feature.

In some embodiments, the connecting base is configured to be removably connected to a part of the watercraft. The connecting base includes: an attachment portion configured to be removably connected to the part of the watercraft; and a fender interface portion defining an interface aperture configured to receive the male connecting feature, the interface aperture being the female connecting feature.

In some embodiments, the attachment portion of the connecting base is configured to be removably connected to a rail of the watercraft that at least partly surrounds a deck of the watercraft.

In some embodiments, the attachment portion of the connecting base is configured to be clipped toollessly onto the rail of the watercraft. the attachment portion is sufficiently flexible to be elastically deformed when being clipped onto the rail.

In some embodiments, the interface aperture extends at least partly in a vertical direction.

In some embodiments, a cross-section of the interface aperture has a same shape as a cross-sectional profile of a part of the male connecting feature that is at least partly insertable into the interface aperture.

In some embodiments, the cross-section of the interface aperture and the cross-sectional profile of the part of the male connecting feature are non-circular.

In some embodiments, the insertion recess of the fender body is defined at least in part by an upper wall facing generally downwardly toward a lower end of the fender body when the first connecting feature engages the second connecting feature, and the male connecting feature extends downwardly from the upper wall when the first connecting feature engages the second connecting feature.

In some embodiments, the fender system also includes an interlocking member connected to the fender body, the interlocking member including the male connecting feature. The fender body is made of a first material and the interlocking member is made of a second material that is stiffer than the first material.

In some embodiments, the male connecting feature of the interlocking member is contained within the insertion recess so as to not extend beyond the peripheral surface of the fender body.

In some embodiments, in order to stow the fender body, the fender body is moved so as to: receive the fender interface portion of the connecting base in the insertion recess of the fender body; and insert the male connecting feature into the interface aperture of the fender interface portion.

In some embodiments, the fender body is generally elongated.

In some embodiments, the fendery system also includes a rope tied to the connecting base and to the fender body so as to attach the fender body to the connecting base when the fender body is deployed on a side of the watercraft.

In some embodiments, the fender body defines a rope aperture extending from an upper end to a lower end of the fender body. The rope extends through the rope aperture.

In some embodiments, an upper end of the fender body defines a retaining aperture extending downwardly from the upper end. The retaining aperture extends from the upper end to the upper wall from which the male connecting feature extends downwardly. The interlocking member includes a fender anchoring portion that is inserted into the retaining aperture to connect the interlocking member to the fender body.

In some embodiments, the fender system also includes a retaining member inserted into the retaining aperture through the upper end of the fender body. The retaining member is configured to retain the fender anchoring portion of the interlocking member inserted into the retaining aperture.

In some embodiments, the retaining aperture is defined in part by an inner shoulder of the fender body facing toward the upper end of the fender body. The retaining member is supported by the inner shoulder of the fender body.

In some embodiments, the fender anchoring portion and the male connecting feature of the interlocking member are offset from one another.

In some embodiments, the first connecting feature is disposed vertically higher than a center of gravity of the fender body when the first connecting feature engages the second connecting feature.

In some embodiments, a watercraft includes: a hull; a deck connected to the hull; a barrier structure at least partly surrounding the deck, the barrier structure including a rail configured for grabbing by a user; and the fender system.

In some embodiments, the rail has a cross-sectional profile having a similar shape as the attachment portion of the connecting base.

In some embodiments, the attachment portion of the connecting base is configured to be clipped toollessly onto the rail of the watercraft, the attachment portion being sufficiently flexible to be elastically deformed when being clipped onto the rail.

According to another aspect of the present technology, there is provided a fender system for a watercraft. The fender system includes: a fender body defining an insertion recess in a peripheral surface of the fender body; and a first connecting feature disposed at least in part in the insertion recess of the fender body. The first connecting feature is configured to engage a second connecting feature disposed on a part of the watercraft for stowing the fender body on the watercraft.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
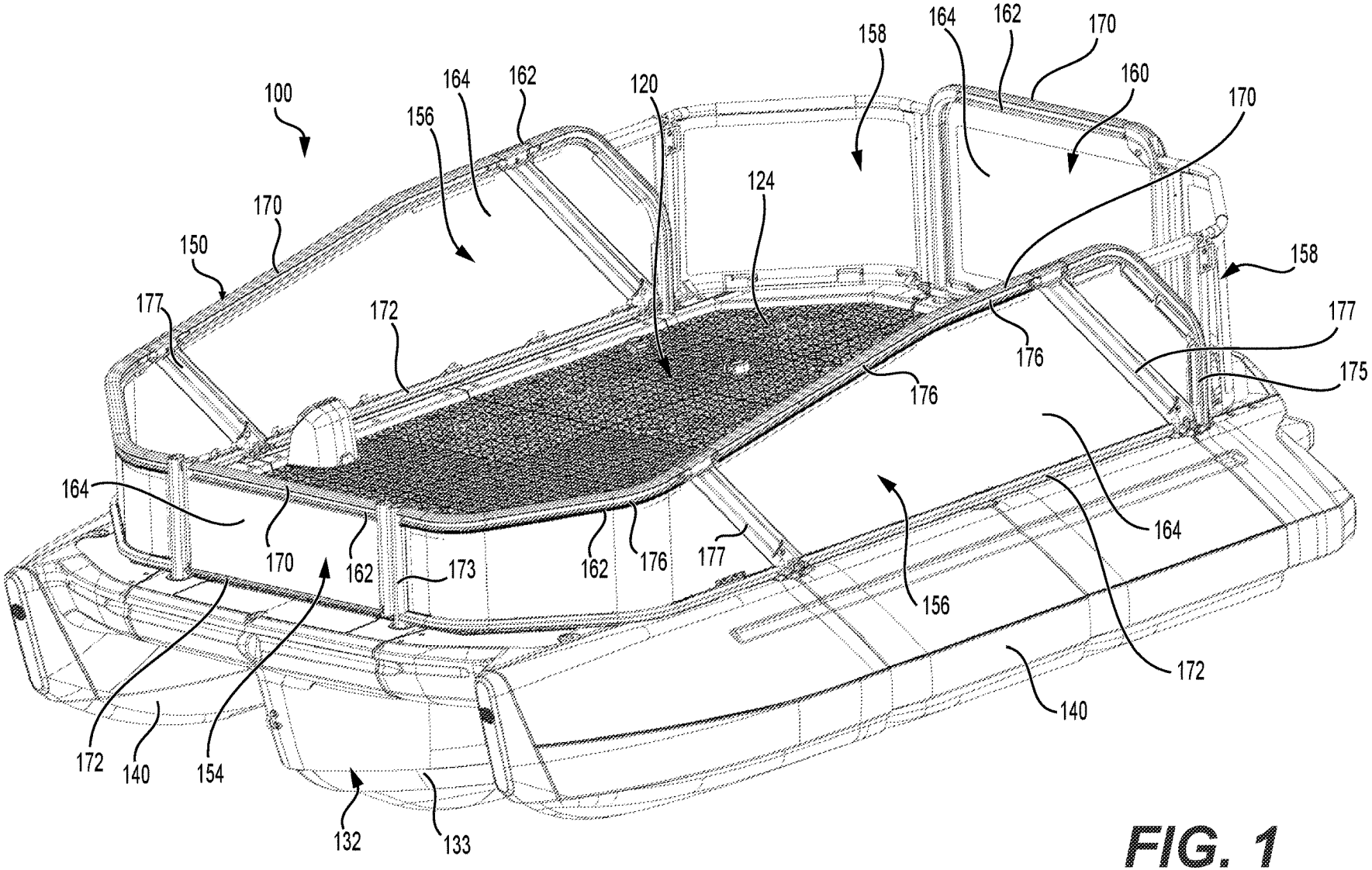
FIG. 1 is a perspective view, taken from a top front left side, of part of a pontoon boat.
Figure 2:
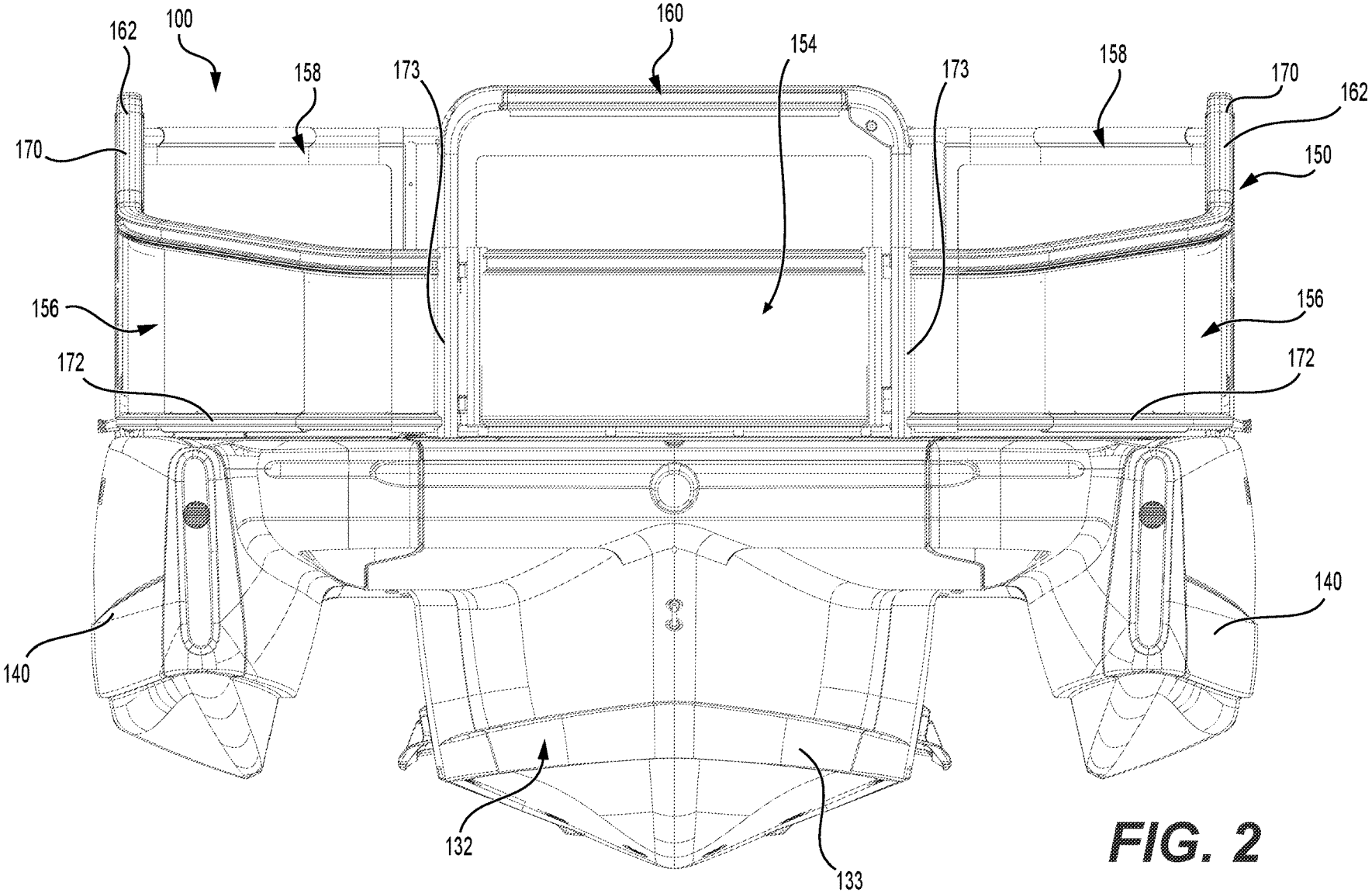
FIG. 2 is a front elevation view of the pontoon boat of FIG. 1.
Figure 3:
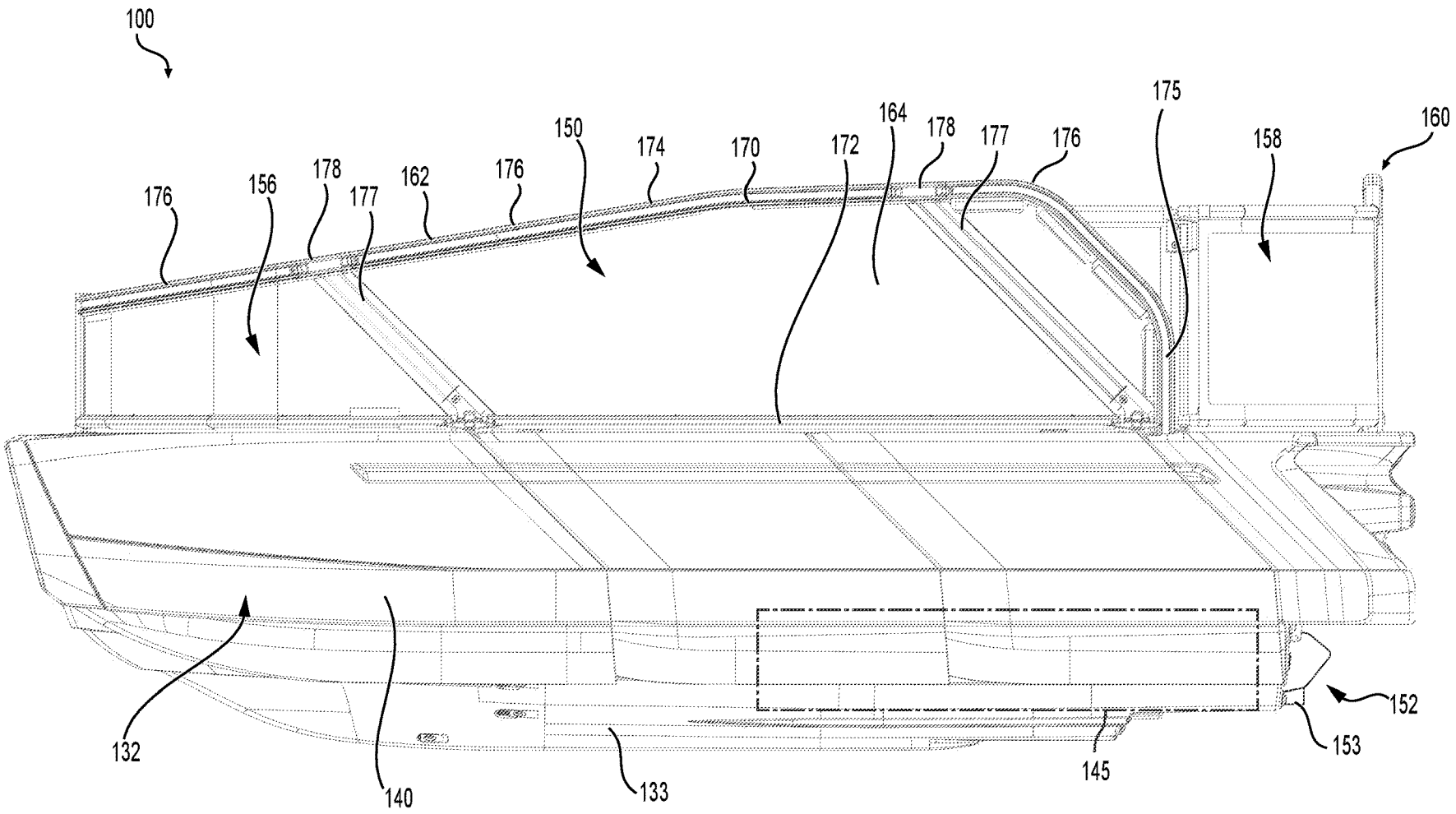
FIG. 3 is a left side elevation view of the pontoon boat of FIG. 1.

With reference to FIGS. 1 to 3, a watercraft 100 configured to be equipped with a fender system 10 (shown in FIG. 5) in accordance with an embodiment of the present technology is shown. The following description relates to one example of a watercraft 100, notably a pontoon boat 100. Those of ordinary skill in the art will recognize that there are other known types of watercraft incorporating different designs and that the present technology would encompass these other watercraft.

The boat 100 has a deck 120 and a hull 132 supporting the deck 120. In this embodiment, the hull 132 includes three separate laterally-adjacent portions that are connected to one another to form the hull 132. Notably, the hull 132 has a central portion 133 and left and right lateral portions 140. These different hull portions could be considered separate hulls in some cases and thus the boat 100 may be referred to as a multihull watercraft in some cases. Nevertheless, it is contemplated that the hull 132 may constitute a single integral portion in other embodiments.

The deck 120 extends above the hull 132 and is supported thereby. The deck 120 has an upper surface 124 for supporting occupants, as well as accessories and accommodations of the boat 10 (e.g., seating, command console, etc.). In this embodiment, as best seen in FIG. 1, the deck 120 includes a plurality of tiles 122 which are configured for attachment of accessories thereto. The tiles 122 form a portion of the upper surface 124 of the deck 120. A more detailed description of the configuration of the tiles 122 and the manner in which they are used for attachment of accessories can be found in U.S. patent application Ser. No. 16/887,481, filed May 29, 2020, which is incorporated herein by reference.

It is contemplated that the deck 120 could have a different construction than that provided by the tiles 122. For instance, the deck 120 could have a more conventional construction such as including a metallic frame and an overlying flooring layer, such as wooden panels or plywood. It is further contemplated that the deck 120 could include multiple levels and/or seating or other accessories integrated therein.

In this embodiment, the hull 132 and the deck 120 have a modular construction. Notably, the hull 132 includes various modular units that are connected to one another to form the hull 132. In particular, the modular units of the hull 132 are longitudinally-adjacent to one another and therefore hulls of different sizes can be assembled depending on how many modular units are connected to one another. Similarly, the deck 120 is modular due to its construction by the tiles 122. Therefore, as will be understood, the boat 100 can have different lengths depending on the modular construction of the deck 120 and the hull 132. The modularity of the hull 132 is described in greater detail in U.S. patent application Ser. No. 17/039,625, filed on Sep. 30, 2020, and in U.S. patent application Ser. No. 17/038,662, filed on Sep. 30, 2020, each of which is incorporated herein by reference.

The boat 100 is propelled by a jet propulsion system 152 (shown in part in FIG. 3) powered by a motor (not shown). The jet propulsion system 152 has a steering nozzle 153 used for steering the boat 100. A handlebar (not shown) is operatively connected to the steering nozzle 153. A throttle lever (not shown) is operatively connected to the motor for controlling operation of the motor. The handlebar and the throttle lever are located on a command console provided on the deck 120. The command console is not shown in the figures in order to properly show the upper surface 124 of the deck 120. It is contemplated that other propulsion systems, such as a stern drive or a marine outboard engine, may be used to propel the boat 100. It is also contemplated that the handlebar could be replaced by a steering wheel and that the steering nozzle 153 could be replaced by an outdrive or one or more rudders.

A power pack 145 of the boat 100 (schematically illustrated in FIG. 3), including the jet propulsion system 152 and the motor, is enclosed in part by the hull 132. Notably, a central hull cover (not shown) overlies the power pack 145 to partly enclose the power pack 145 between the hull 132 and the hull cover. An upper surface of the central hull cover is contiguous with the upper surface 124 of the deck 120 (i.e., flush therewith).

The boat 100 has a barrier structure 150 surrounding at least part of the deck 120 and extending upwardly therefrom. In particular, the barrier structure 150 is located along a periphery of the boat 100 (as defined by the deck 120). As shown in FIGS. 1 to 3, in this embodiment, the barrier structure 150 generally surrounds the entirety of the deck 120. Notably, the barrier structure 150 includes a front end portion 154, left and right lateral portions 156, left and right rear corner portions 158, and a rear end portion 160. It is contemplated that, in other embodiments, the barrier structure 150 could only partially surround the deck 120. For example, one or more of the portions 154, 156, 158, 160 could be omitted.

The construction of the lateral portions 156 will be described briefly below as their construction is applicable to other portions of the barrier structure 150. As the left and right lateral portions 156 are mirror images of one another about a longitudinal centerplane of the boat 100, only the left lateral portion 156 will be described in detail herein. It is to be understood that the same description applies to the right lateral portion 156.

Figure 4:
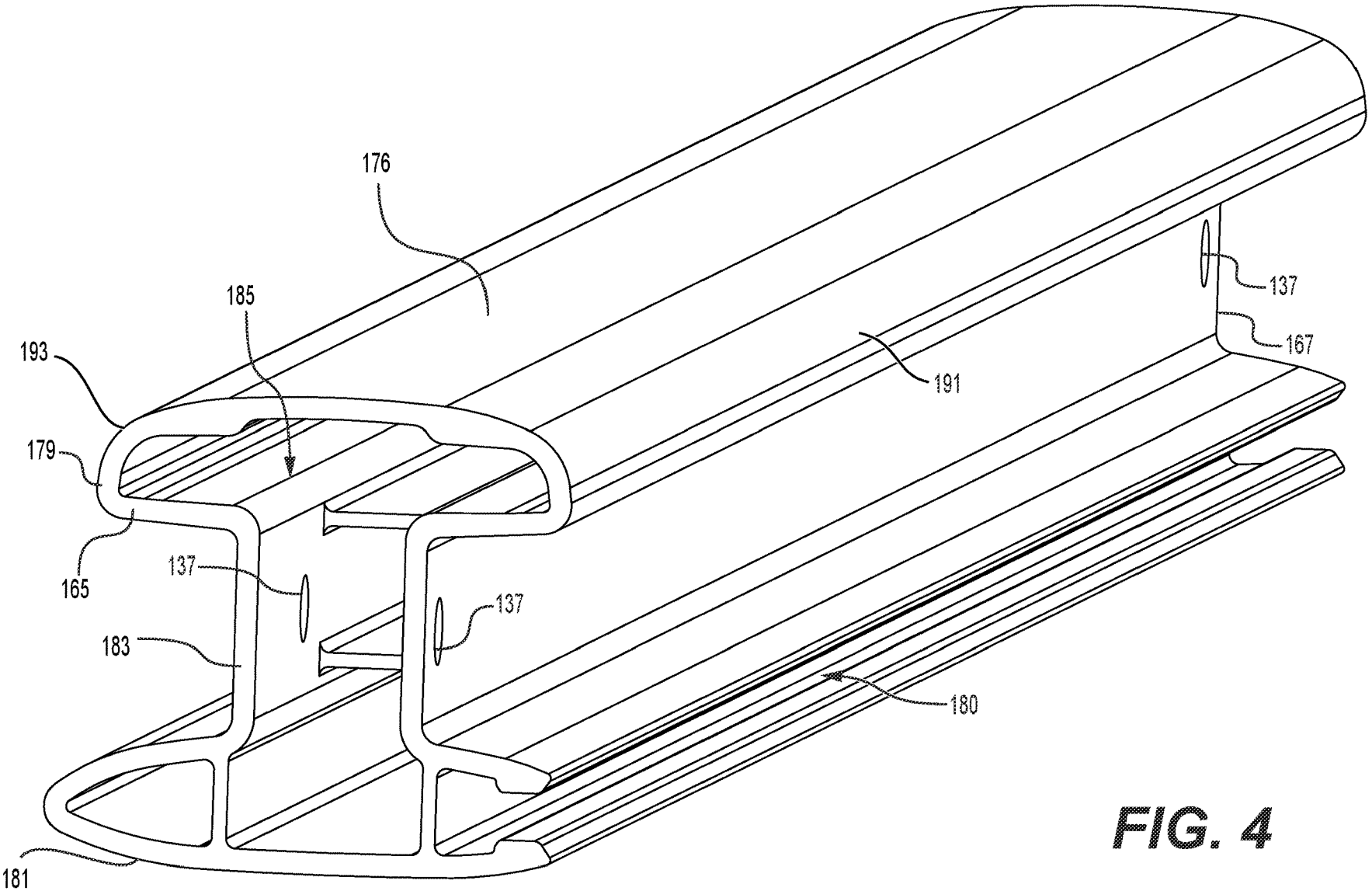
FIG. 4 is a perspective view, taken from a top front left side, of a rail member of a left lateral portion of a barrier structure of the pontoon boat of FIG. 1.
Figure 5:
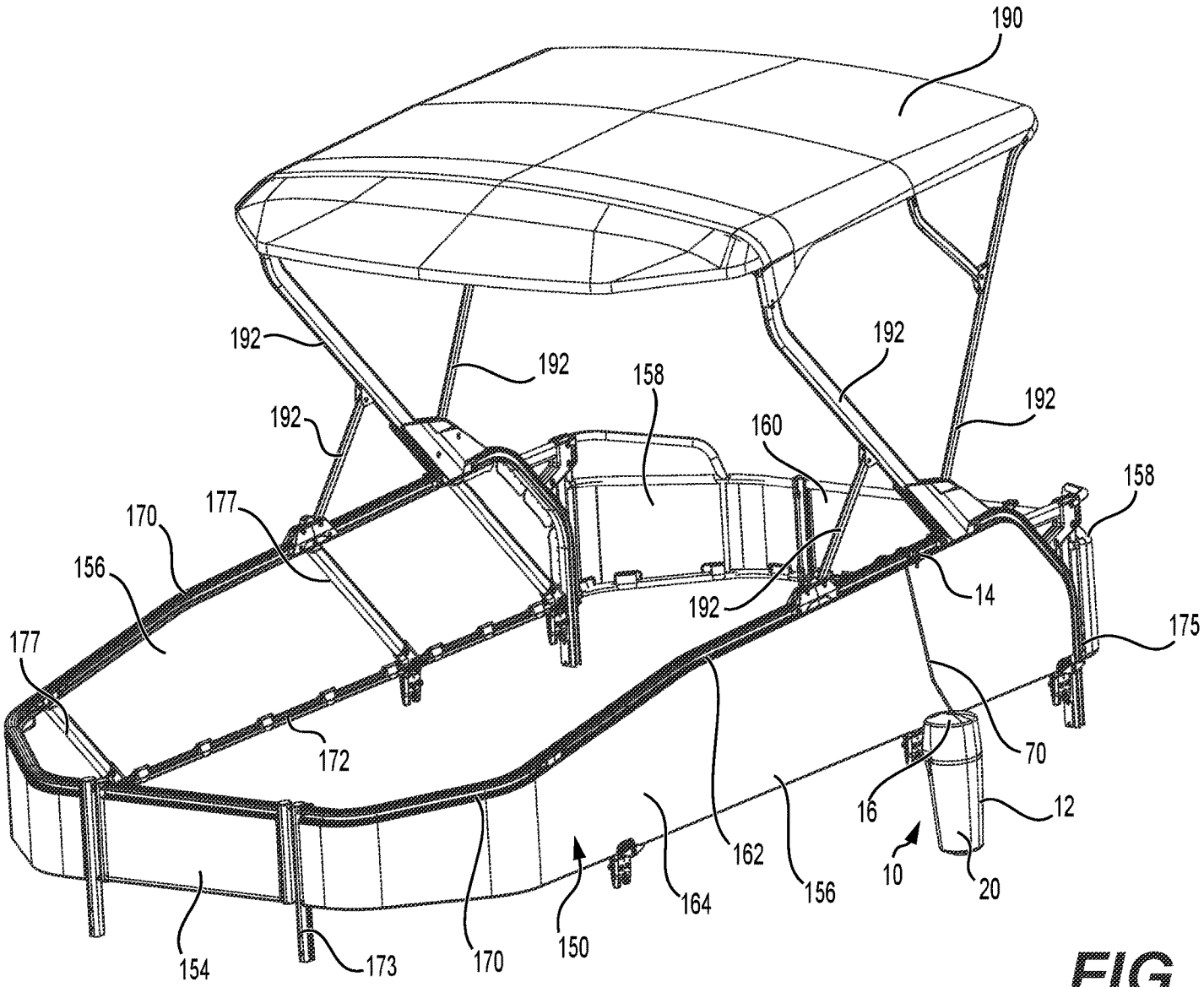
FIG. 5 is a perspective view, taken from a top front left side, of the barrier structure and a bimini top of the pontoon boat of FIG. 1 and a fender system in accordance with an embodiment of the present technology secured to the boat in a deployed state.

With reference to FIGS. 3 to 5, the lateral portion 156 of the barrier structure 150 has a frame 162 and a pliable sheet wall 164 connected thereto. The frame 162 connects the lateral portion 156 of the barrier structure 150 to the hull 132 of the boat 100. The pliable sheet wall 164 is stretched over the frame 162 to form an enclosure around the deck 120.

The frame 162 has an upper portion 170 and a lower portion 172 connected to one another. Notably, a front end member 173, a rear end member 175 and a plurality of support members 177 extend between the upper and lower portions 170, 172 of the frame 162. The support members 177 (best seen in FIGS. 1 and 3), which are disposed longitudinally between the front and rear end members 173, 175, extend generally upwardly and forwardly from the lower portion 172 to the upper portion 170. The front and rear end members 173, 175 are connected to the hull 132. The spacing between the upper and lower portions 170, 172 can vary. For instance, in this embodiment, the vertical distance between the upper and lower portions 170, 172 is smallest near the front end of the frame 162 and greatest near the rear end of the frame 162.

The upper portion 170 of the frame 162 includes a rail 174 configured for grabbing by a user's hand. The rail 174 is thus also commonly referred to as a "hand rail" or a "grab rail". Notably, in the present application, the rail 174 is defined as a structure that can be grabbed by a user's hand and extends at the minimum 24 inches above the deck 120, in compliance with American Boat and Yacht Council (ABYC) H-41 regulations on "Reboarding Means, Ladders, Handholds, Rails and Lifelines". The rail 174 includes a plurality of rail members 176 that are connected to one another by interconnectors 178 (FIG. 3) extending between consecutive ones of the rail members 176. Notably, each interconnector 178 is fastened to two of the rail members 176. The interconnectors 78 are also used for connecting the support members 177 between the upper and lower portions 170, 172 of the frame 162.

Figure 8:
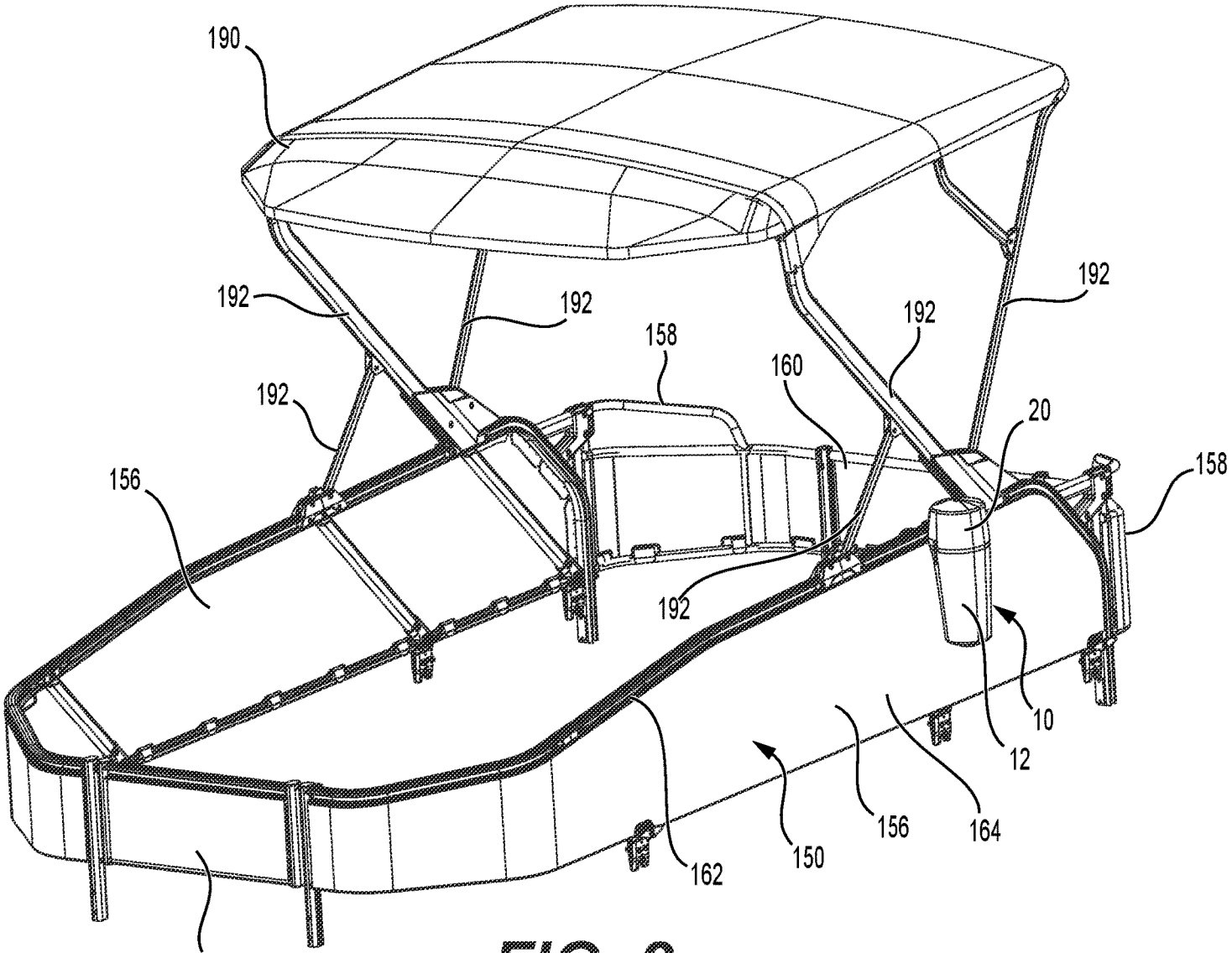
FIG. 8 is a perspective view, taken from a top front left side, of the barrier structure and the bimini top of the pontoon boat of FIG. 1 and the fender system of FIG. 5 in a stowed state.
Figure 9:
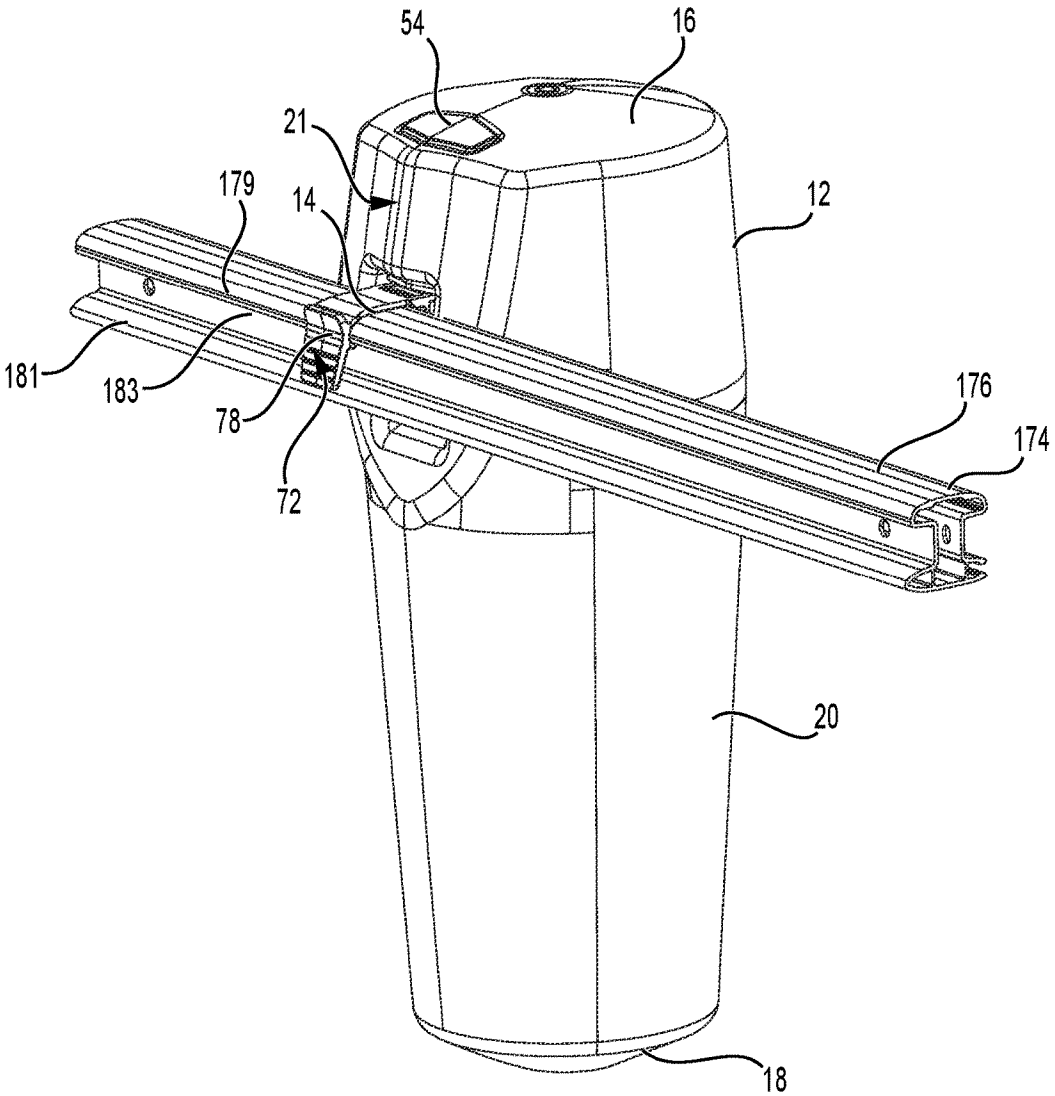
FIG. 9 is a perspective view, taken from a top front right side, of the fender system of FIG. 8 in the stowed state and the rail member to which the connecting base is connected.

The length of the lateral portion 156 of the barrier structure 150 can be changed simply by adding or removing rail members 176 to make the rail 174 longer or shorter. This allows adapting the barrier structure 150 in accordance with the size of the boat 100 that it is intended to be installed on. For instance, FIGS. 5 and 8 show the barrier structure 150 in another arrangement in which additional rail members 176 are provided for each of the lateral portions 156, thus making the longitudinal length of the lateral portions 156 (and thus the barrier structure 150) greater than that shown in FIGS. 1 to 3. Moreover, as will be noticed in FIGS. 5 and 8, the rear corner portions 158 and the rear end portion 160 are configured differently than the shown in FIGS. 1 to 3.

In this embodiment, each rail member 176 has the same cross-sectional profile shown in FIG. 4. Therefore, only one of the rail members 176 will be described in detail herein. It is understood that the same description applies to the other rail members 176 unless mentioned otherwise. As can be seen in FIG. 4, the cross-sectional profile of the rail member 176 is generally I-shaped, notably including a wide upper portion 179, a wide lower portion 181 and a narrow intermediate portion 183 extending between the wide upper and lower portions 179, 181. In this embodiment, the rail member 176 is an extruded component and defines an interior hollow space 185 therein. Near its opposite ends 165, 167, the rail member 176 has openings 137 defined in the narrow intermediate portion 183 for receiving respective fasteners for connecting the rail member 176 to a corresponding interconnector 178 (FIG. 3) or one of the front end member 173 and the rear end member 175.

In order to connect the pliable sheet wall 164 to the rail 174, the rail member 176 defines a channel 180 extending along a length of the rail member 176. Notably, the channel 180 is configured to receive an interlocking member of the pliable sheet wall 164 so as to connect the pliable sheet wall 164 to the rail 174.

A more complete description of the lateral portion 156 of the barrier structure 150, including the connection of the pliable sheet wall 164 to the rail 174 and the lower portion 172 of the frame 162, can be found in U.S. patent application Ser. No. 17/164,195, filed on Feb. 1, 2021, the entirety of which is incorporated herein by reference.

As shown in FIGS. 5 and 8, the boat 100 also includes a bimini top 190 connected to the upper portion 170 of the frame 162. Notably, a plurality of top support members 192 interconnect the bimini top 190 to the rails 174 of the lateral portions 156.

The fender system 10 includes a fender body 12 configured to protect the boat 100 from damage when the boat 100 is proximate an obstacle (e.g., another watercraft, a dock, etc.). Notably, the fender body 12 can be placed in a deployed position, shown in FIG. 5, whereby the fender body 12 is protecting the hull 132 of the boat 100, and in a stowed position, shown in FIG. 8, whereby the fender body 12 is stored on the boat 100 and not positioned to protect the hull 132. It should be noted that, for simplicity, FIGS. 5 and 8 illustrate a single fender system 10. However, it is to be understood that the boat 100 can be equipped with multiple fender systems such as the fender system 10. The fender system 10 will now be described in greater detail with reference to FIGS. 5 to 22.

As will be described in detail below, in order to stow the fender body 12 on the boat 100, the fender system 10 also includes a connecting base 14 disposed on the boat 100, connected to the rail 174 of the left lateral portion 156 and configured to be connected to the fender body 12 when the fender body 12 is in the stowed position. The connecting base 14 could alternatively be connected to any other suitable one of the portions 154, 156, 158, 160 of the barrier structure 150.

Figure 12:
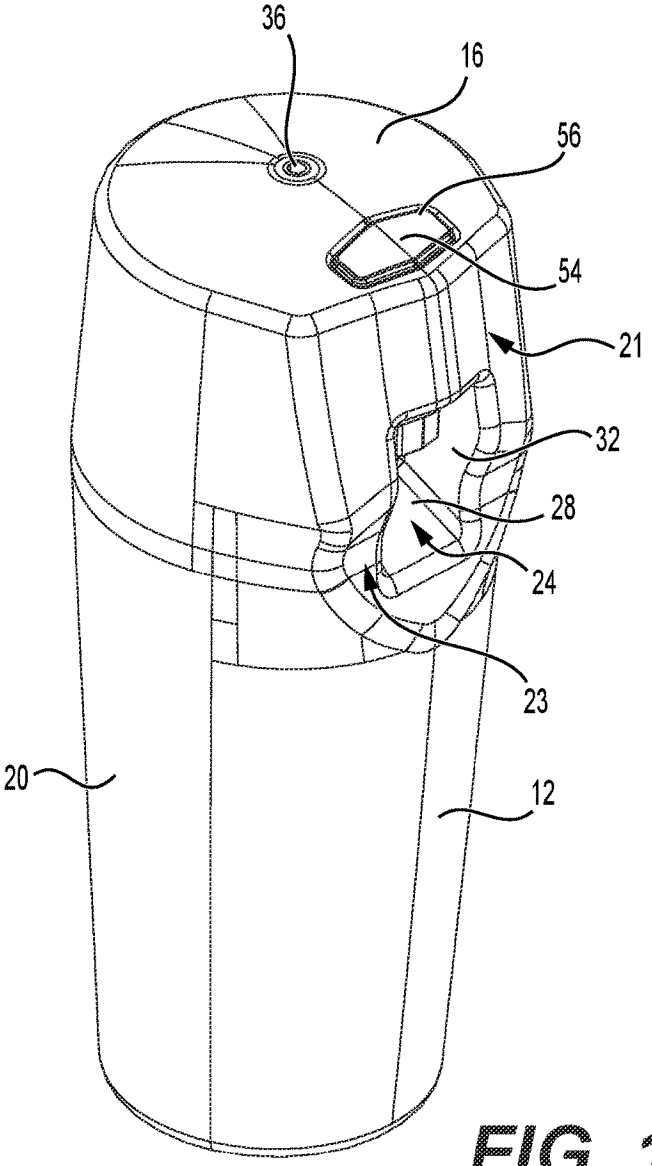
FIG. 12 is a perspective view, taken from a rear right side, of a fender assembly including a fender body and an interconnecting member of the fender system of FIG. 5.
Figure 15:
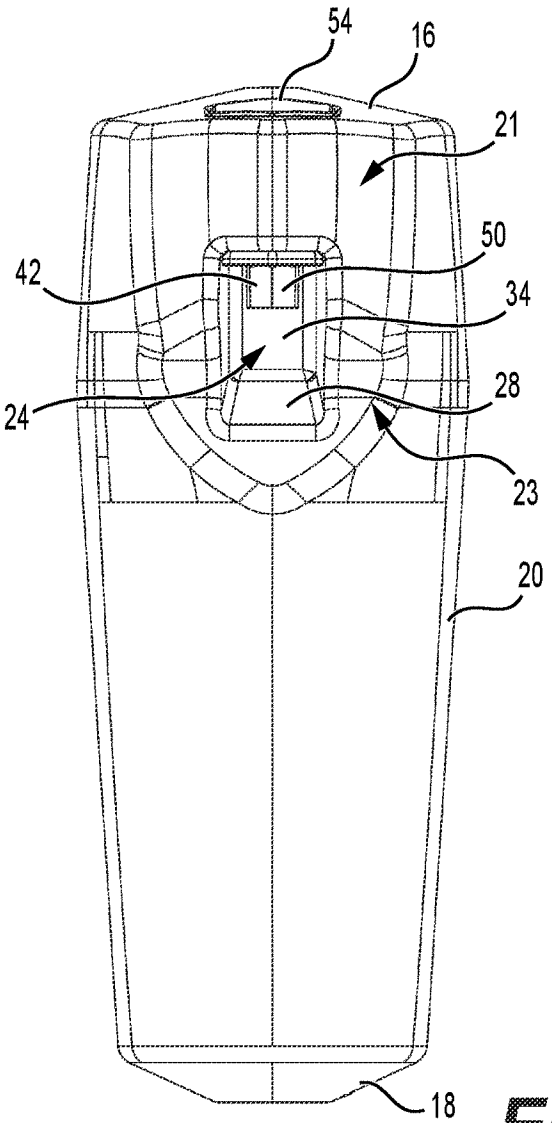
FIG. 15 is a right side elevation view of the fender assembly of FIG. 12.
Figure 14:
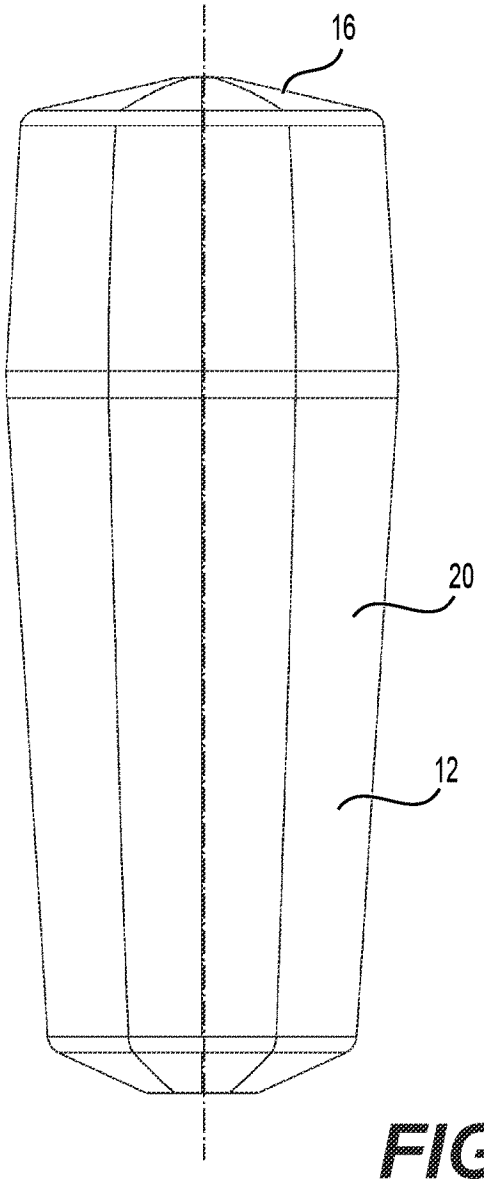
FIG. 14 is a left side elevation view of the fender assembly of FIG. 12.
Figure 16:
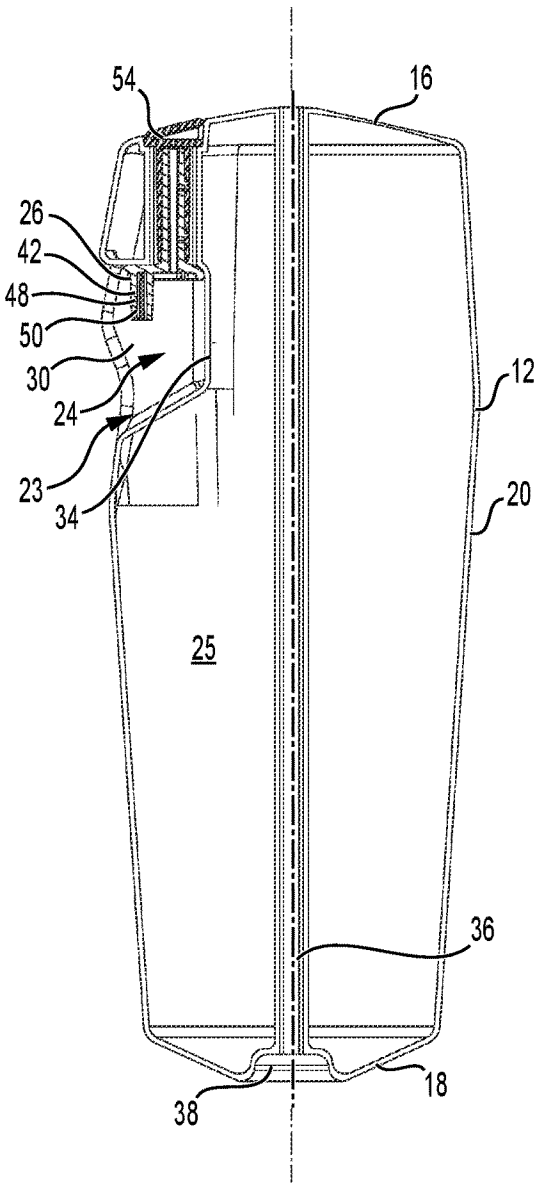
FIG. 16 is a cross-sectional view of the fender assembly of FIG. 12 taken along line 16-16 in FIG. 13.

With reference to FIGS. 12 to 15, the fender body 12 is generally elongated and has an upper end 16 and a lower end 18. In use, the upper end 16 of the fender body 12 faces upwardly when the fender body 12 is deployed on the side of the boat 100. An outer peripheral surface 20 of the fender body 12 extends between the upper and lower ends 16, 18. In this embodiment, the outer shape of the fender body 12, as defined by the upper and lower ends 16, 18 and the peripheral surface 20, is generally cylindrical. However, as shown in FIGS. 12, 15 and 16, the fender body 12 has a relatively flat section 21 on one side of the outer peripheral surface 20 and a curved section 23 extending downwardly from the flat section 21. The curved section 23 defines a concave space. As will be described in more detail below, the concave space defined by the curved section 23 receives the rail 174 when the fender body 12 is stowed on the boat 100.

It is contemplated that the fender body 12 could have a different shape in other embodiments (e.g., spherical, cuboid, etc.).

The fender body 12 is made of a pliable material to allow the fender body 12 to elastically deform when compressed between the boat 100 and an obstacle. In this embodiment, the fender body 12 is made of polymeric material. In particular, in this embodiment, the fender body 12 is made of polyvinyl chloride (PVC). It is contemplated that any other suitable material may be used in other embodiments. Furthermore, in this embodiment, as shown in FIG. 16, the fender body 12 is also generally hollow, defining an interior space 25 therein. In particular, in this embodiment, the fender body 12 is inflated into its given shape and sealed. It is contemplated that the fender body 12 may not be hollow in other embodiments.

As can be seen in FIGS. 12 and 16, the fender body 12 defines an insertion recess 24 in the outer peripheral surface 20. In particular, the insertion recess 24 is defined by an upper wall 26, a lower wall 28, two opposite side walls 30, 32 and a bottom wall 34 (defining a "bottom" of the recess 24). As will be described in more detail below, the insertion recess 24 provides a place to conceal, in the fender body 12, a connection arrangement that allows the fender body 12 to be connected to the connecting base 14. As such, the connection arrangement is less likely to be impacted by any obstacle when the fender system 10 is in the deployed state. The connection arrangement will be described in greater detail below.

Figure 7:
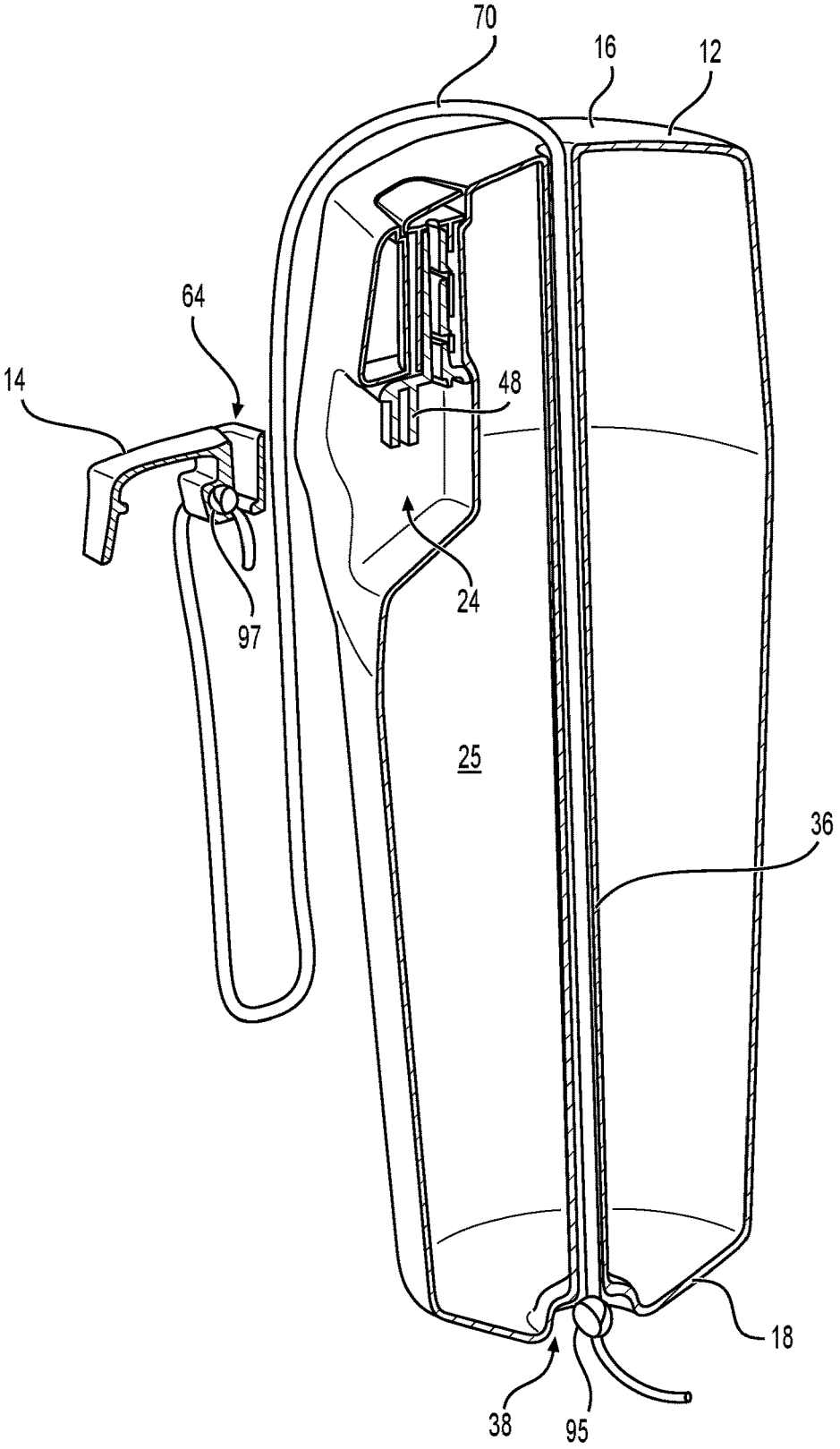
FIG. 7 is a perspective view of a cross-section of the fender system in an exploded configuration showing the connecting base tied to a fender body of the fender system by a rope.
Figure 13:
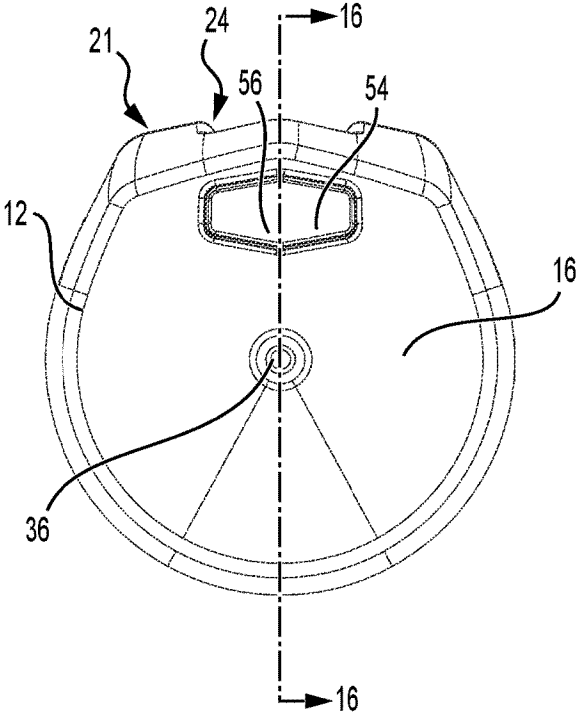
FIG. 13 is a top plan view of the fender assembly of FIG. 12.

The fender body 12 is configured to be secured to the boat 100 by a rope 70. When the fender system 10 is in the deployed state, the fender body 12 hangs from the rope 70. To that end, as best seen in FIGS. 13 and 16, the fender body 12 defines a rope aperture 36 extending from the upper end 16 to the lower end 18 of the fender body 12. In this embodiment, the rope aperture 36 is located centrally relative to the peripheral surface 20 of the fender body 12. The rope 70 extends through the rope aperture 36, notably being inserted into the rope aperture 36 through the upper end 16 of the fender body 12. As shown in FIG. 7, the rope 70 is tied into a knot 95 at the lower end 18 of the fender body 12 so as to secure the fender body 12 to the rope 70 as the knot 95 prevents the rope 70 from being pulled out of the rope aperture 36. A knot recess 38 is defined at the lower end 18 of the fender body 12 for the knot 95 formed by the rope 70 to sit in, thereby concealing the knot 95 when the fender body 12 is viewed from its sides. As can be understood from FIG. 7, in order to change the height at which the fender body 12 is disposed in the deployed position, the knot 95 can be tied at different positions along the rope 70 accordingly.

It is contemplated that, in some embodiments, rather than tying the knot 95, a stopper could be connected to the rope 70 to prevent the rope 70 from being pulled from the rope aperture 36.

Figure 17:
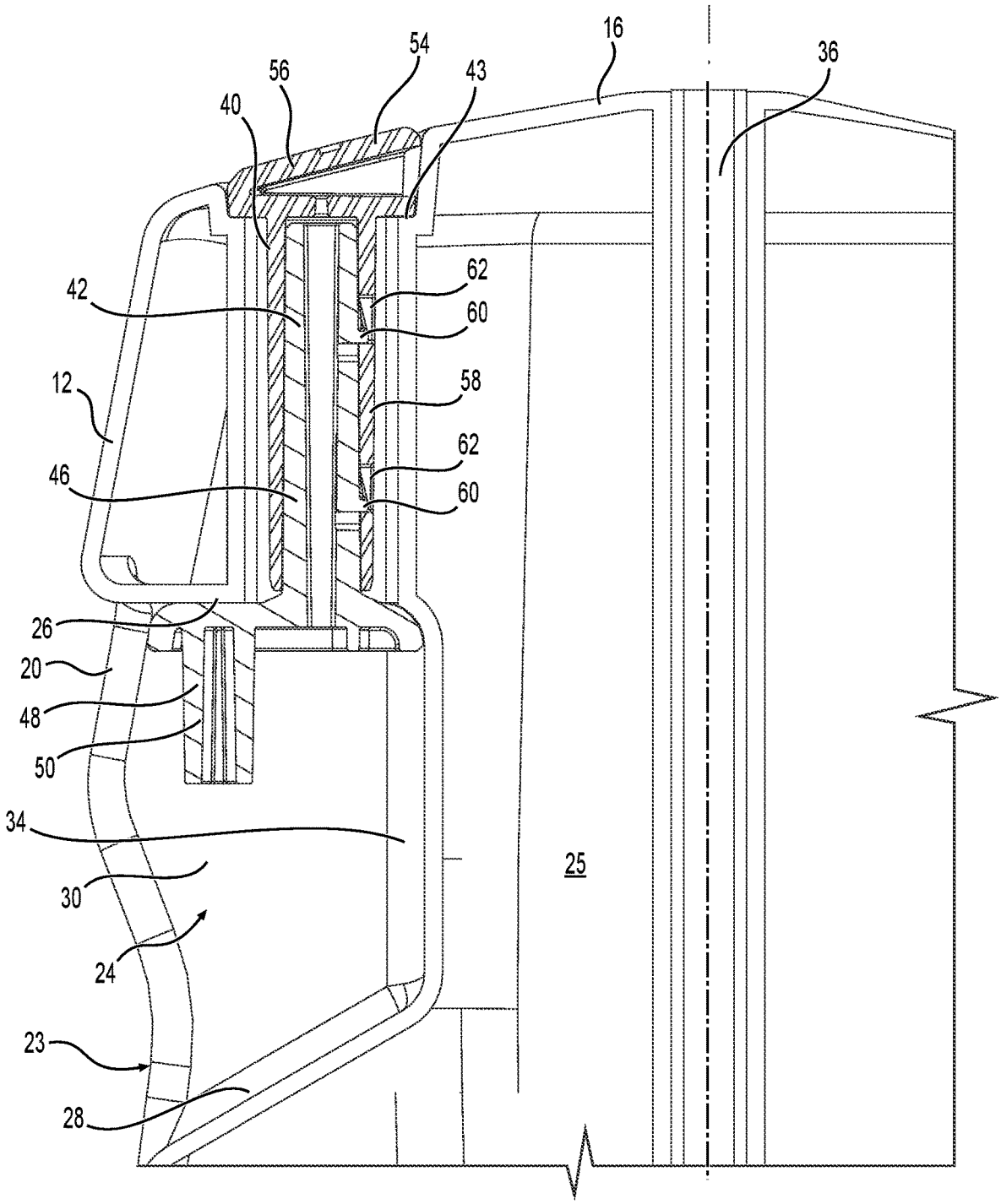
FIG. 17 is a detailed view of part of FIG. 16.

As shown in FIG. 17, the fender body 12 also defines a retaining aperture 40 which extends downwardly from the upper end 16 to the upper wall 26 defining the insertion recess 24. The retaining aperture 40 therefore opens up into the insertion recess 24 at the upper wall 26. The retaining aperture 40 is defined in part by an inner shoulder 43 of the fender body 12 facing toward the upper end 16. As will be described in more detail below, the retaining aperture 40 is provided to retain an interlocking member 42 to the fender body 12.

In order to stow the fender body 12 on the watercraft 10, the fender system 10 implements a male-female connecting arrangement that allows easy and quick connection of the fender body 12 to the connecting base 14 disposed on the watercraft 10. Notably, in this embodiment, and as will be described below, the connecting arrangement includes a male connecting feature 50 and a female connecting feature 52 that correspond to one another so that the female connecting feature 52 is configured to receive the male connecting feature 50 therein.

Figure 18:
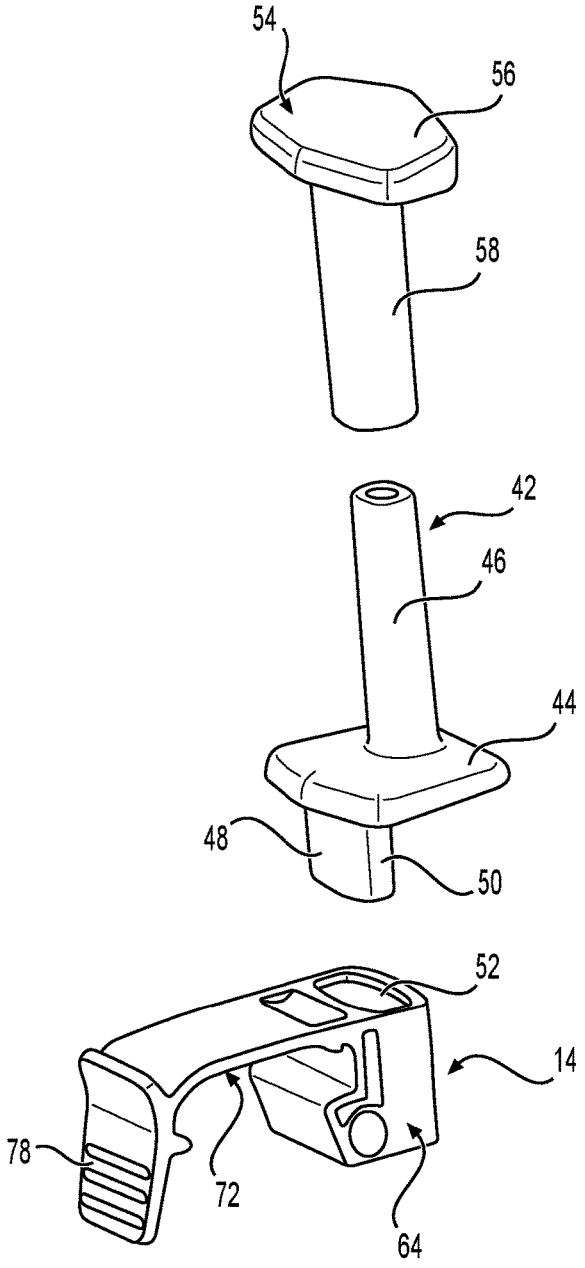
FIG. 18 is a perspective view, taken from a front right side, of an exploded configuration of a retaining member, the interconnecting member and the connecting base of the fender system of FIG. 5.
Figure 19:
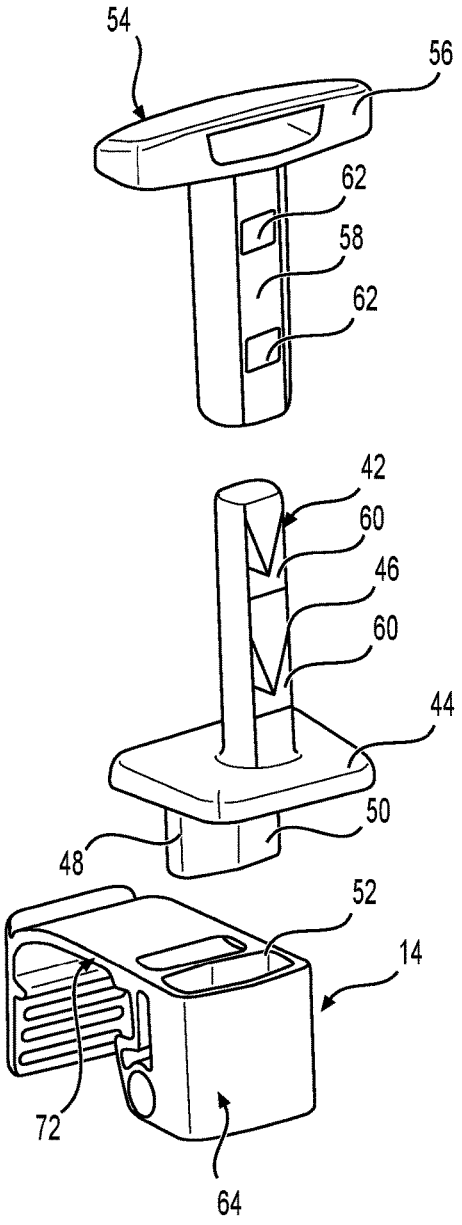
FIG. 19 is a perspective view, taken from a front left side, of the exploded configuration of FIG. 18.

With reference to FIGS. 18 and 19, as described above, in this embodiment, the fender system 10 includes the interlocking member 42 which comprises the male connecting feature 50. The interlocking member 42 is disposed in part within the insertion recess 24 of the fender body 12. The interlocking member 42 comprises a platform 44, a fender anchoring portion 46 extending from an upper side of the platform 44, and a post 48 extending from a lower side of the platform 44. The fender anchoring portion 46 and the post 48 thus extend from the platform 44 in opposite directions. In this embodiment, as can be seen in FIG. 17, the fender anchoring portion 46 and the post 48 are offset from one another. In other words, the fender anchoring portion 46 and the post 48 extend from different parts of the platform 44 so that respective projections of the fender anchoring portion 46 and the post 48 on a platform plane (not shown) extending generally parallel to the platform 44 are spaced apart from one another. As will be explained below, this offset relationship between the fender anchoring portion 46 and the post 48 facilitates connection of the interlocking member 42 with the connecting base 14.

The fender anchoring portion 46 is configured to connect the interlocking member 42 to the fender body 12. In particular, in this embodiment, the fender anchoring portion 46 collaborates with a retaining member 54 of the fender system 10, best shown in FIGS. 18 and 19, to connect the interlocking member 42 to the fender body 12. The retaining member 54 has a head portion 56 and a tubular portion 58 extending downwardly from the head portion 56. The retaining member 54 is inserted into the retaining aperture 40 of the fender body 12 through the upper end 16 to retain the fender anchoring portion 46 of the interlocking member 42. As can be seen in FIG. 17, the head portion 56 is supported by the inner shoulder 43.

Thus, with the retaining member 54 in place on the fender body 12, in order to connect the interlocking member 42 to the fender body 12, the interlocking member 42 is inserted into the insertion recess 24 and then the fender anchoring portion 46 is inserted into the retaining aperture 40 defined in the upper wall 26 where it is received by the tubular portion 58 of the retaining member 54.

In this embodiment, the retaining member 54 is made of the same material as the interlocking member 42.

In this embodiment, the fender anchoring portion 46 has a cross-sectional profile that is generally stadium-shaped. However, it is contemplated that the fender anchoring portion 46 could have any other suitable cross-sectional shape. The fender anchoring portion 46 is sized and shaped so as to have a sliding fit engagement with the tubular portion 58 when the fender anchoring portion 46 is inserted therein. The tubular portion 58 thus has an inner surface which has a cross-section having a same shape as the cross-sectional profile of the fender anchoring portion 46.

With reference to FIGS. 17 and 19, in order to allow the tubular portion 58 of the retaining member 54 to retain the fender anchoring portion 46 of the interlocking member 42, the fender anchoring portion 46 has a pair of tabs 60 on a side of the fender anchoring portion 46 facing in a direction away from the post 48. When the fender anchoring portion 46 is slid into the tubular portion 58 of the retaining member 54, the tabs 60 are pushed inwardly into the body of the fender anchoring portion 46. However, once the fender anchoring portion 46 is slid into the tubular portion 58 sufficiently, each tab 60 is aligned with a respective aperture 62 defined in a corresponding side of the tubular portion 58. The tabs 60 thus return to their original positions by moving into the apertures 62. Once the tabs 60 are disposed in the apertures 62, the tabs 60 prevent the fender anchoring portion 46 from sliding out of the tubular portion 58 of the retaining member 54.

It is contemplated that, in alternative embodiments, the interlocking member 42 could be fixed to the fender body 12 in another manner. For instance, in such embodiments, the retaining member 54 may be omitted and the interlocking member 42 could be fixed to the fender body 12 in other manners, such as by other mechanical fasteners, or by overmolding the interlocking member 42 when forming the fender body 12.

As shown in FIGS. 17 to 19, in this embodiment, the post 48 of the interlocking member 42 is the male connecting feature 50 of the connection arrangement defined by the fender system 10 to connect the fender body 12 to the connecting base 14. Notably, the post 48 is received by the female connecting feature 52 which will be described in greater detail below. In this embodiment, the post 48 has a cross-sectional profile that is generally hexagonal. The post 48 may have any other suitable shape in other embodiments. The post 48 tapers downwardly such that a dimension of the post 48 is greater near the platform 44 than at a lower end of the post 48. Moreover, as can be seen in FIG. 17, when the interlocking member 42 is connected to the fender body 12, the post 48 is contained within the insertion recess 24 so as to not extend beyond the peripheral surface 20 of the fender body 12. This helps ensure that the post 48 will not come into contact with the side of the hull 132 of the boat 100 or an obstacle such as a dock when the fender body 12 is in the deployed position. Moreover, the post 48 is disposed sufficiently deep within the insertion recess 24 so that the post 48 does not come into contact with the side of the hull 132 or an obstacle even when the fender body 12 is compressed between the boat 100 and the obstacle. Furthermore, the post 48 is disposed vertically higher than a center of gravity of the fender body 12. This can be helpful in ensuring the stability of the connection between the fender body 12 and the connecting base 14 when the fender body 12 is in the stowed position.

The interlocking member 42 is made of a material that is less pliable than the material of the fender body 12. Notably, the material of the interlocking member 42 is stiffer than the material of the fender body 12. This greater stiffness of the material of the interlocking member 42 facilitates the connection of the fender body 12 to the connecting base 14 via the interlocking member 42 and favours a stable connection therebetween. For instance, in this embodiment, the interlocking member 42 is made at least in part of a molded plastic. In particular, the interlocking member 42 is made of a polymeric composite including a matrix made of polypropylene and glass fiber reinforcement. In this embodiment, the content of glass fiber reinforcement within the polymeric composite is 10% by volume.

It is contemplated that the interlocking member 42 could be made of any other suitable material in other embodiments.

With reference now to FIGS. 20 to 23, in this embodiment, the connecting base 14 comprises the female connecting feature 52 with which the male connecting feature 50 of the interlocking member 42 (i.e., the post 48) is configured to be mated. Notably, an accessory interface portion 64 of the connecting base 14 defines the female connecting feature 52. In particular, in this embodiment, the female connecting feature 52 is an interface aperture 66 defined at an upper end 63 of the accessory interface portion 64 and extending generally in a vertical direction along the accessory interface portion 64. In the present embodiment, the accessory in question is a fender and, as such, the accessory interface portion 64 will be referred to hereinafter as a fender interface portion 64. It will be appreciated that other accessories other than fenders could be connected to the connecting base 14.

Figure 23:
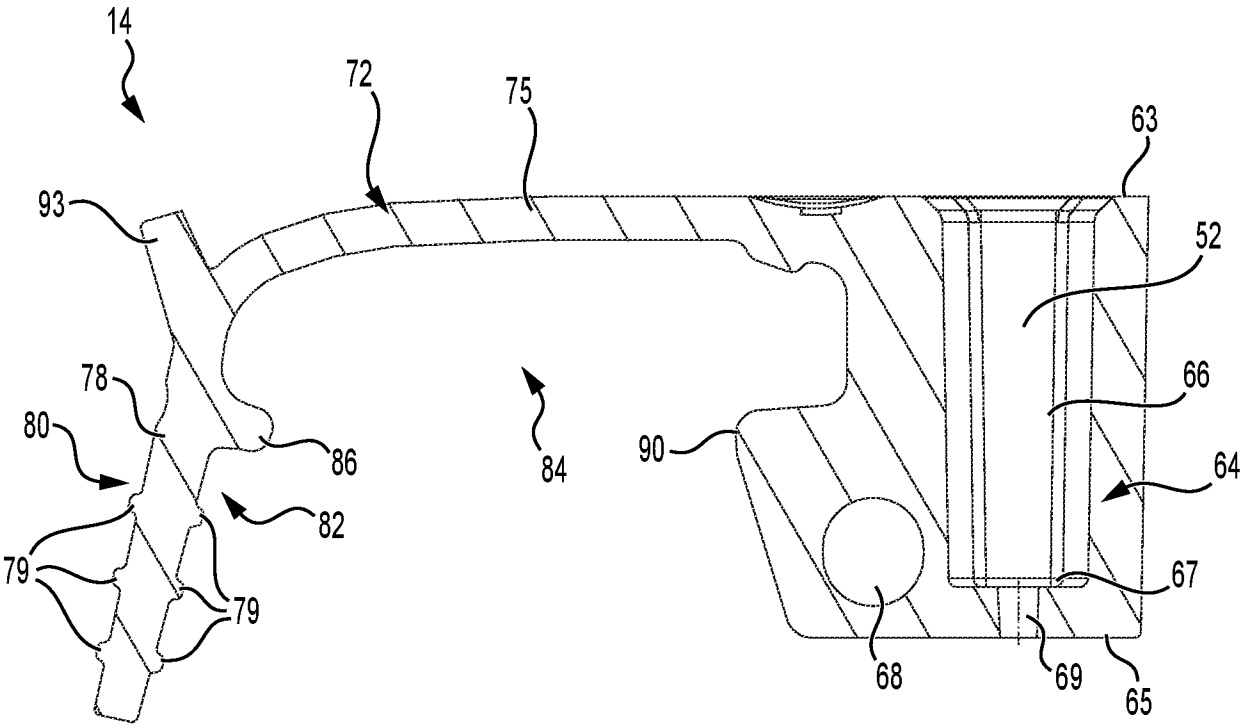
FIG. 23 is a cross-sectional view of the connecting base of FIG. 20 taken along line 23-23 in FIG. 22.

The interface aperture 66 has a cross-section that has a same shape as the cross-sectional profile of the post 48. For instance, in this embodiment, the cross-section of the interface aperture 66 and the cross-sectional profile of the post 48 are non-circular, and in particular hexagonal in shape. Moreover, the post 48 is sized such that its cross-sectional profile is slightly smaller than the cross-section of the interface aperture 66 such that the post 48 is in a loose fit with the fender interface portion 64 when received in the interface aperture 66. As such, the fit of the post 48 within the interface aperture 66, as ensured by their matching non-circular shapes and their dimensions, substantially limits rotation of the post 48 relative to the connecting base 14 when the post 48 is received in the interface aperture 66. Furthermore, as can be seen in FIG. 23, the interface aperture 66 tapers downwardly such that the dimensions of the interface aperture 66 are greater at the upper end 63 of the fender interface portion 64. This tapering of the interface aperture 66, together with the tapering of the post 48, provides a better fit of the post 48 within the interface aperture 66.

In this embodiment, as shown in FIG. 23, the interface aperture 66 is a blind hole. Notably, the interface aperture 66 is limited by a bottom surface 67 defining a "bottom" of the interface aperture 66. A relief aperture 69 is defined by the bottom surface 67 and extends to a lower end 65 of the fender interface portion 64 for allowing air and water to be evacuated from the interface aperture 66 when the post 48 is inserted therein.

Figure 20:
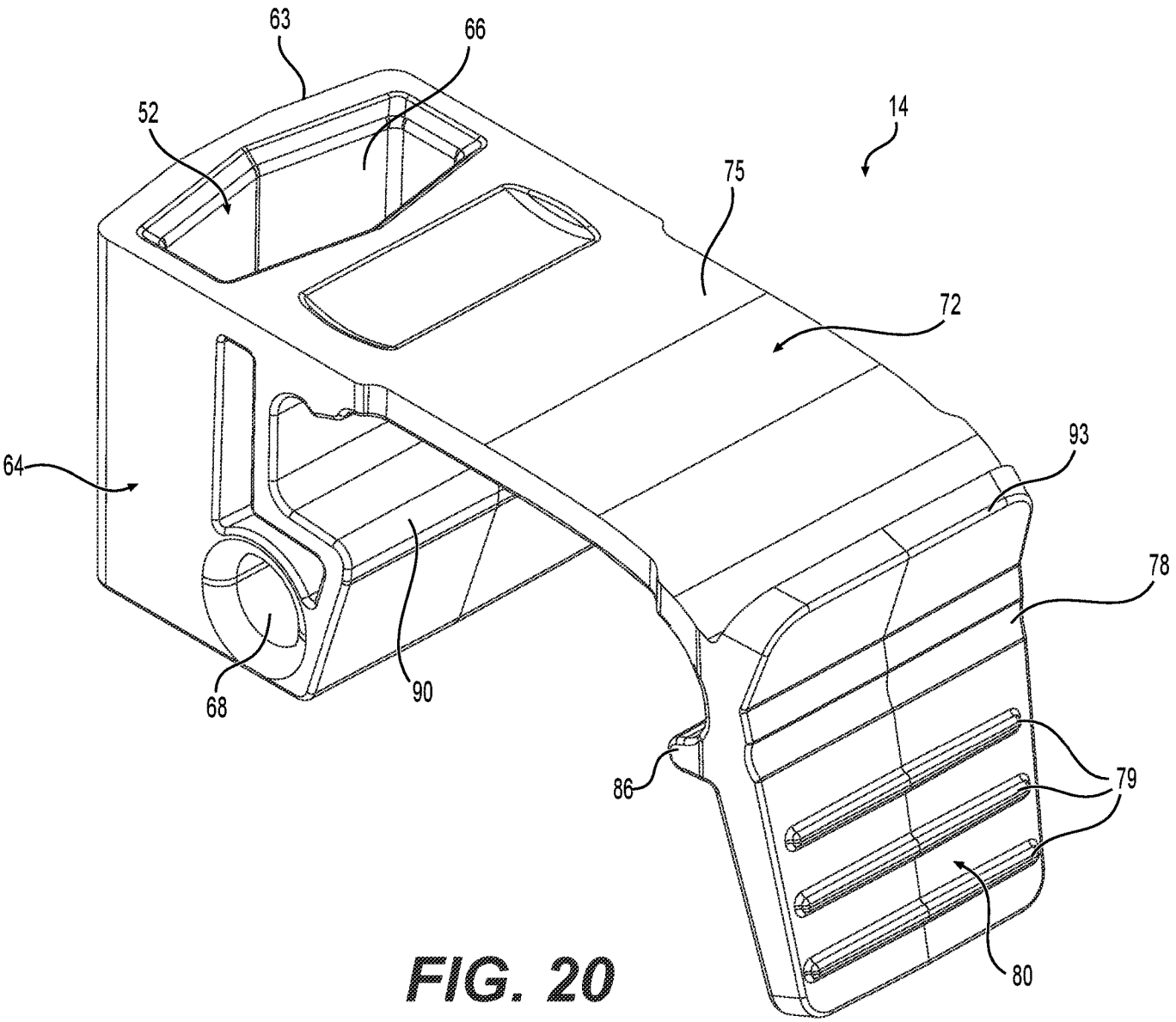
FIG. 20 is a perspective view, taken from a rear right side, of the connecting base of the fender system of FIG. 5.
Figure 21:
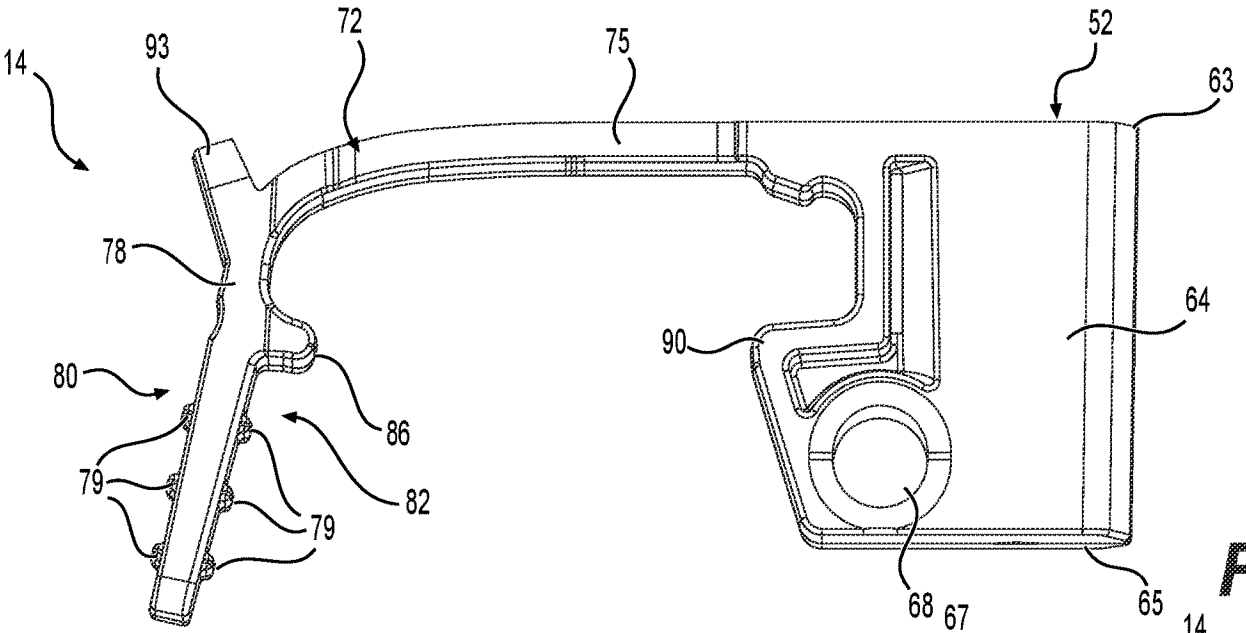
FIG. 21 is a front elevation view of the connecting base of FIG. 20.
Figure 22:
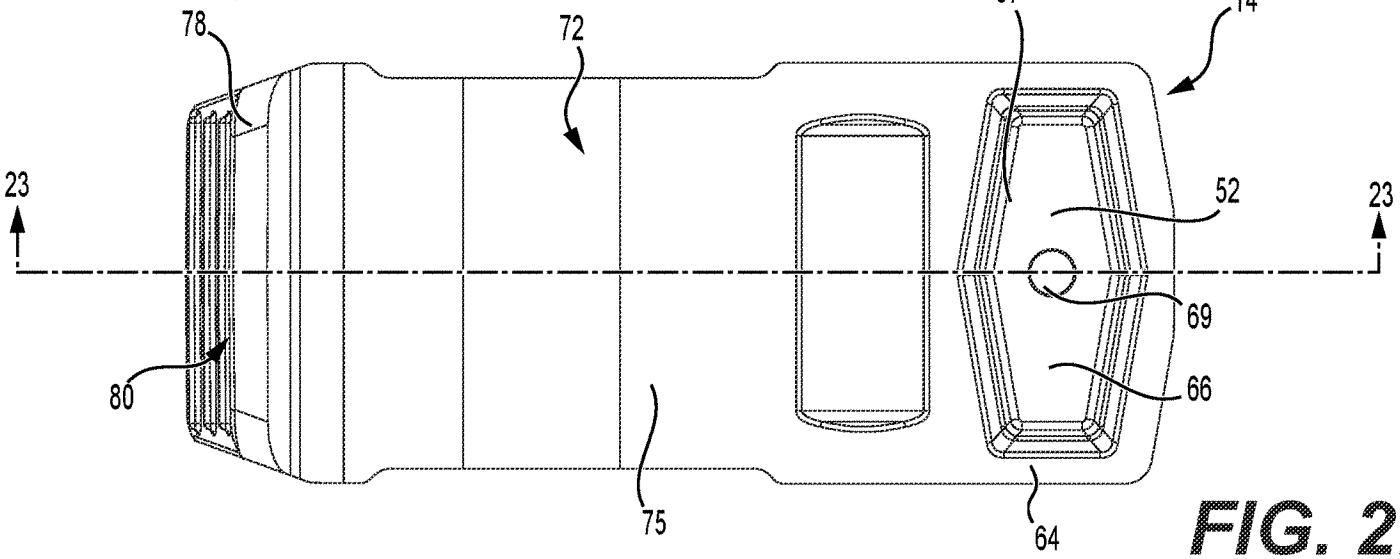
FIG. 22 is a top plan view of the connecting base of FIG. 20.

As shown in FIGS. 20, 21 and 23, near its lower end 65, the fender interface portion 64 also defines a rope aperture 68 extending generally horizontally (i.e., in a direction perpendicular to the interface aperture 66) when the connecting base 14 is mounted to the corresponding rail 174. The rope aperture 68 is configured to receive the rope 70 therein. In particular, as shown in FIG. 7, once the rope 70 is inserted through the rope aperture 68, the rope 70 is tied into a knot 97 at one end of the rope aperture 68 so that the rope 70 cannot be pulled out of the rope aperture 68. Similar to the position of the knot 95, the knot 97 can be tied at different positions along the rope 70 in order to change the height at which the fender body 12 is disposed in the deployed position.

It is contemplated that, in some embodiments, rather than tying the knot 97, a stopper could be connected to the rope 70 to prevent the rope 70 from being pulled from the rope aperture 68.

With reference to FIGS. 9 to 11 and 20 to 23, the connecting base 14 also has an attachment portion 72 that is configured to be removably connected to the corresponding rail 174. That is, the attachment portion 72 of the connecting base 14 can be selectively connected to and disconnected from the rail 174 of any portion 152, 154, 156, 158, 160 of the boat 100. In particular, as will be described in detail below, the attachment portion 72 is configured to be clipped toollessly onto the corresponding rail 174 of the boat 100. In other words, the attachment portion 72 can be clipped onto the corresponding rail 174 without using any tools (e.g., a screwdriver, a wrench, etc.) such that a user can clip the attachment portion 72 onto the corresponding rail 174 simply by handling the attachment portion 72 directly with the user's hand.

Alternatively, in other embodiments, the connecting base 14 could be connected to the rail 174 by using tools.

Furthermore, in other embodiments, the connecting base 14 could be an integral part of the rail 174.

The attachment portion 72 of the connecting base 14 is shaped so as to partially surround part of the corresponding rail 174 when the connecting base 14 is connected to the rail 174. Notably, the attachment portion 72 has a similar shape as a cross-sectional profile of the wide upper portion 179 of the rail 174. In particular, an upper part 75 of the attachment portion 72 extends from the upper end 63 of the fender interface portion 64 in a generally horizontal direction (i.e., transversally to the direction in which the interface aperture 66 extends). A lateral part 78 of the attachment portion 72 extends downwardly from the upper part 75 at an end of the upper part 75 opposite the fender interface portion 64. The lateral part 78 has a plurality of ridges 79 for facilitating grasping by a user's hand. The ridges 79 are provided on an outer side 80 and on an inner side 82 of the lateral part 78. The inner side 82 of the lateral part 78 faces toward the fender interface portion 64 while the outer side 80 faces away from the fender interface portion 64. A thumb support 93 extends from the outer side 80 of the lateral part 78 and is configured to support a thumb of the user's hand when handling the connecting base 14 to connect the connecting base 14 to the rail 174.

Figure 11:
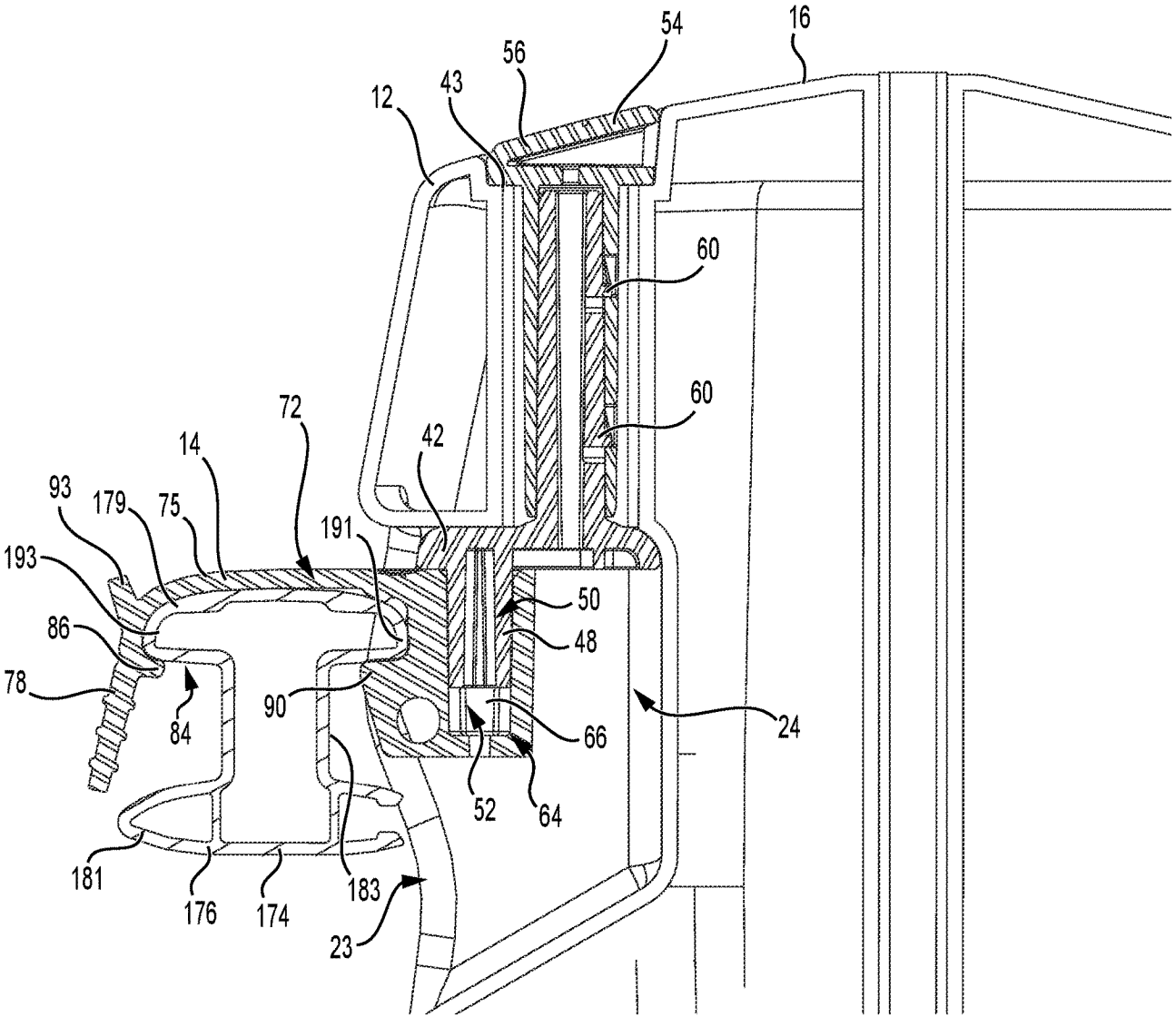
FIG. 11 is part of a cross-sectional view of the fender system and the rail member of FIG. 9, taken along line 11-11 in FIG. 10.

With reference to FIG. 23, in order for the connecting base 14 to be clipped onto the corresponding rail 174, the attachment portion 72 cooperates with the fender interface portion 64 to define a rail-receiving recess 84 therebetween for receiving part of a corresponding rail 174. In particular, as shown in FIG. 11, the rail-receiving recess 84 has a cross-section that is shaped and sized to accommodate the cross-sectional profile of the wide upper portion 179 of the rail member 176 of the corresponding rail 174. In this embodiment, the cross-section of the rail-receiving recess 84 is generally C-shaped. The cross-section of the rail-receiving recess 84 can have any other suitable shape in other embodiments in accordance with the shape of cross-sectional profile of the rail 174. To form the C-shape of the cross-sectional profile of the rail-receiving recess 84, in this embodiment, the lateral part 78 of the attachment portion 72 has an upper protrusion 86 that protrudes toward the fender interface portion 64 on the inner side 82 of the lateral part 78. Moreover, the fender interface portion 64 has a shoulder 90 facing inwardly toward the lateral part 78 of the attachment portion 72.

It is contemplated that, in alternative embodiments, the attachment portion 72 alone may form the rail-receiving recess 84.

The attachment portion 72 is dimensioned to be sufficiently flexible so as to be elastically deformed when being clipped onto the rail 174. For instance, as can be seen in FIG. 23, the thickness of the upper part 75 of the attachment portion 72 is small enough to allow the upper part 75 to bend elastically under an applied force. Moreover, in this embodiment, the connecting base 14 is made of polymeric material, namely polyoxymethylene (POM)—also known as acetal. It is contemplated that, in other embodiments, the connecting base 14 could be made of the same material as the interlocking member 42. The material of the connecting base 14 contributes in allowing the attachment portion 72 to be sufficiently flexible to be elastically deformed when being clipped onto the trail 174, as will be described in more detail below.

Figure 6:
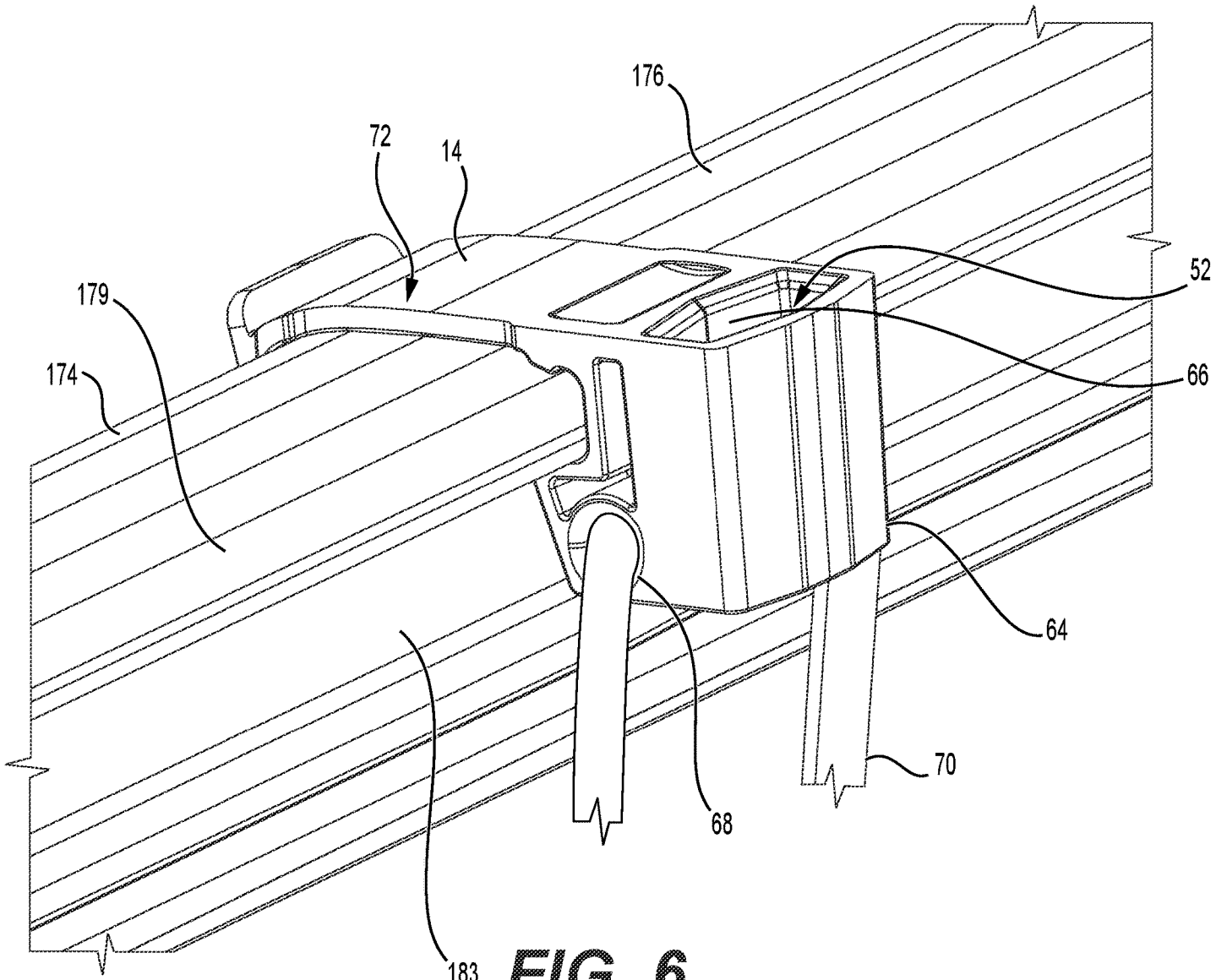
FIG. 6 is a detailed view of part of FIG. 5, showing a connecting base of the fender system connected to the rail member of FIG. 4.

With reference to FIG. 11, in order to mount the connecting base 14 to the rail 174 as shown, the connecting base 14 is positioned atop the rail 174 with the fender interface portion 64 near an outer lateral end 191 of the wide upper portion 179 of the rail 174 and the lateral part 78 of the attachment portion 72 near the inner lateral end 193 of the wide upper portion 179 of the rail 174. The attachment portion 72 is then pushed downwardly onto the rail 174. The protrusion 86 on the inner side 82 of the lateral part 78 thus slides down the curved shape of the second lateral end 193 of the wide upper portion 179 of the rail 174 while the upper part 75 elastically bends so that the lateral part 78 moves away from the fender interface portion 64 until the protrusion 86 moves down past the inner lateral end 193 of the wide upper portion 179 and the shoulder 90 moves down past the outer lateral end 191 of the wide upper portion 179. As the protrusion 86 is moved below the inner lateral end 193, attachment portion 72 elastically deforms back to be in its original configuration. The upper part 75 thus springs back so that the protrusion 86 moves below the inner lateral end 193 and the shoulder 90 moves below the outer lateral end 191. The wide upper portion 179 of the rail 174 is thus received in the rail-receiving recess 84 and the connecting base 14 applies a force on both lateral ends 191, 193 of the rail 174 such that the connecting base 14 is safely secured to the rail 174. At this stage, if it desired to disconnect the connecting base 14 form the rail 174, a substantial force has to be applied on the lateral part 78 of the attachment portion 72 to pull the lateral part 78 away from the fender interface portion 64 in order to disconnect the connecting base 14 from the rail 174. This is helpful to prevent the connecting base 14 from being accidentally disconnected from the rail 174. As can be seen in FIG. 6, in this embodiment, when the connecting base 14 is connected to the rail 174, the fender interface portion 64 overhangs the rail 174. This can free up space on the deck 120 of the boat 100 when the fender body 12 is in the stowed position.

As will be understood, this manner of connecting the connecting base 14 to the rail 174 is easy and quick to perform by a user. Moreover, it allows the user to easily displace the connecting base 14 to any desired location along the rail 174 and thereby change the deployed position and stowing position of the fender body 12. For instance, the connecting base 14 can be connected to the rail 174 of any other of the portions 154, 156, 158, 160 of the barrier structure 150 of the boat 100. Furthermore, while in this embodiment the fender interface portion 64 overhangs the rail 174 on an outer side of the rail 174 (i.e., away from the deck 120), the connecting base 14 can alternatively be connected to the rail 174 such that the fender interface portion 64 overhangs the rail 174 on an inner side of the rail 174 (i.e., toward the deck 120), which may be desirable when the fender system 10 is in a stowed state.

If not already done, once the connecting base 14 is connected to the rail 174, the fender body 12 is tied to the connecting base 14 by the rope 70 as described above. Notably, the rope 70 is inserted into the rope aperture 36 of the fender body 12 and into the rope aperture 68 of the connecting base 14. As described above, the two knots 95, 97 formed by the rope 70 thereby secure the fender body 12 to the connecting base 14 so that the fender body 12 can be deployed as shown in FIG. 5 to protect the boat 100. It is understood that the fender body 12 can move (e.g., turn) when in the deployed position and thus may not be in the exactly as illustrated in FIG. 5 when in the deployed position.

When it is desired to stow the fender body 12 on the boat 100, the fender body 12 is pulled back onto the boat 100 via the rope 70 and the interlocking member 42 is mounted to the connecting base 14. In particular, the fender body 12 is moved so as to receive the fender interface portion 64 of the connecting base 14 in the insertion recess 24 of the fender body 12, and then insert the post 48 into the interface aperture 66 of the fender interface portion 64. The connecting base 14 thus supports the weight of the fender body 12 when the fender body 12 is in the stowed position. As can be seen in FIG. 11, the offset relationship between the post 48 and the fender anchoring portion 46 allows sufficient clearance between the post 48 and the bottom wall 34 defining the insertion recess 24 so as to facilitate placing the fender interface portion 64 into a position to receive the post 48 in the interface aperture 66.

Figure 10:
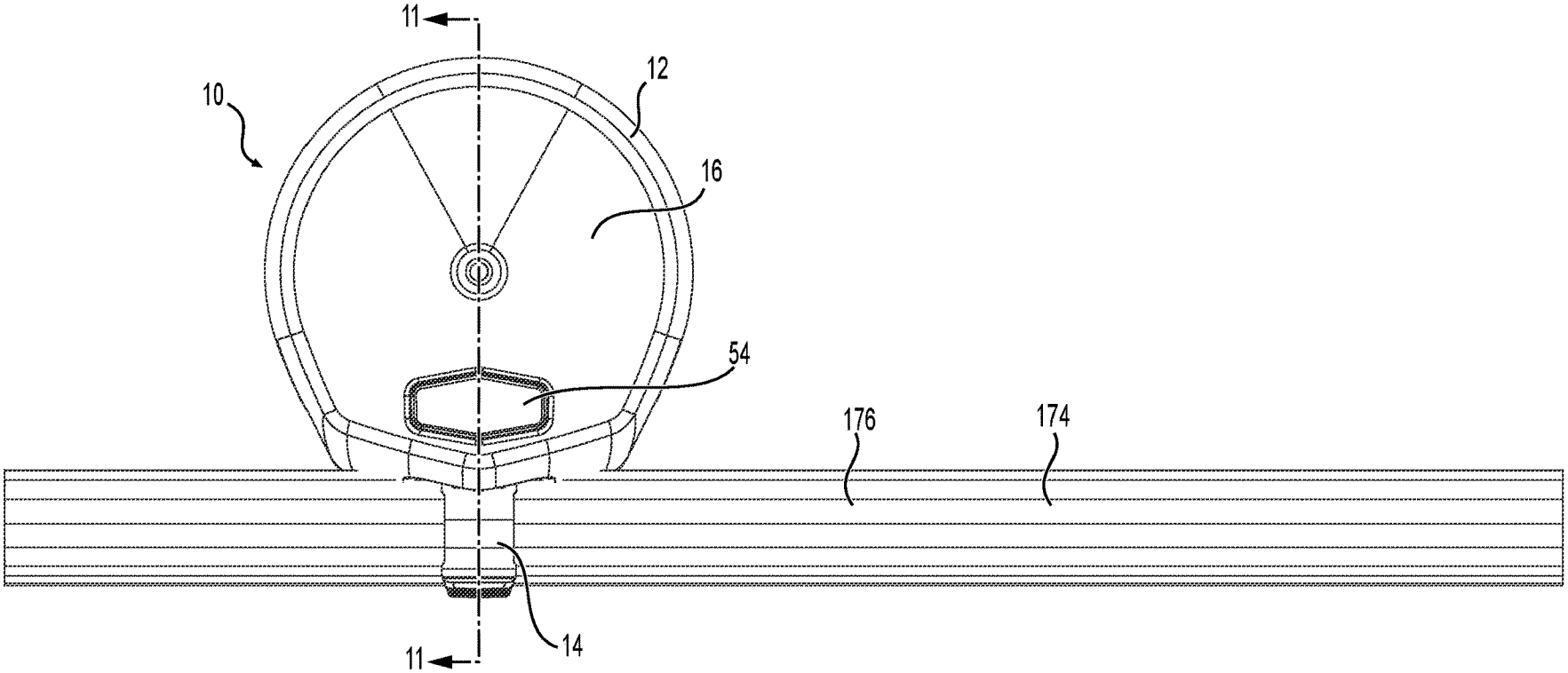
FIG. 10 is a top plan view of the fender system and the rail member of FIG. 9.

With reference to FIG. 10, in this embodiment, when the fender body 12 is connected to the connecting base 14 to stow the fender body 12, the fender body 12 is pressed against the rail 174 to which the connecting base 14 is connected, thereby preventing the fender body 12 from rotating relative to the connecting base 14. In particular, as shown in FIG. 11, the wide lower portion 181 of the rail 174 is received in the concave space defined by the curved section 23 of the fender body 12.

It is contemplated that, in alternative embodiments, the positions of the male connecting feature 50 and the female connecting feature 52 may be reversed. That is, the male connecting feature 50 could be provided on the connecting base 14 while the female connecting feature 52 is provided on the fender body 12 (e.g., an aperture or recess in the upper wall 26).

Furthermore, it is contemplated that, in some embodiments, the fender system 10 may not include the connecting base 14, and rather the rail 174 itself or another part of the boat 100 could integrate the female connecting feature 52 (or alternatively the male connecting feature).

Lastly, it will be appreciated that a connecting base 14 such as that described herein could be used in conjunction with various accessories other than a fender body 12. For example, an accessory system including the connecting base 14 mounted to (or integrated into) a rail such as the rail 174 could receive an accessory, such as a cup holder or a fishing rod holder, that includes a downwardly extending post 48.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A fender system for a watercraft, comprising:

a fender body defining an insertion recess in a peripheral surface of the fender body, the fender body being generally cylindrical, the peripheral surface being a curved surface extending between an upper end and a lower end;

a first connecting feature disposed at least in part in the insertion recess of the fender body; and a connecting base configured to be connected to the watercraft, the connecting base comprising a second connecting feature, the first connecting feature being configured to engage the second connecting feature for stowing the fender body on the watercraft, the insertion recess being defined at least in part by an upper wall facing generally downwardly towards a lower end of the fender body when the first connecting feature engages the second connecting feature.

2. The fender system of claim 1, wherein:

one of the first connecting feature and the second connecting feature is a male connecting feature; and an other one of the first connecting feature and the second connecting feature is a female connecting feature configured to receive at least part of the male connecting feature therein.

3. The fender system of claim 2, wherein:

the first connecting feature is the male connecting feature; and the second connecting feature is the female connecting feature.

4. The fender system of claim 3, wherein the connecting base is configured to be removably connected to a part of the watercraft, the connecting base comprising:

an attachment portion configured to be removably connected to the part of the watercraft; and a fender interface portion defining an interface aperture configured to receive the male connecting feature, the interface aperture being the female connecting feature.

5. The fender system of claim 4, wherein the attachment portion of the connecting base is configured to be removably connected to a rail of the watercraft that at least partly surrounds a deck of the watercraft.

6. The fender system of claim 5, wherein the attachment portion of the connecting base is configured to be clipped toollessly onto the rail of the watercraft, the attachment portion being sufficiently flexible to be elastically deformed when being clipped onto the rail.

7. The fender system of claim 4, wherein the interface aperture extends at least partly in a vertical direction.

8. The fender system of claim 4, wherein a cross-section of the interface aperture has a same shape as a cross-sectional profile of a part of the male connecting feature that is at least partly insertable into the interface aperture.

9. The fender system of claim 8, wherein the cross-section of the interface aperture and the cross-sectional profile of the part of the male connecting feature are non-circular.

10. The fender system of claim 1, wherein:

the first connecting feature extends downwardly from the upper wall when the first connecting feature engages the second connecting feature.

11. The fender system of claim 10, further comprising an interlocking member connected to the fender body, the interlocking member comprising the first connecting feature, wherein:

the fender body is made of a first material; and the interlocking member is made of a second material that is stiffer than the first material.

12. The fender system of claim 11, wherein the first connecting feature of the interlocking member is contained within the insertion recess so as to not extend beyond the peripheral surface of the fender body.

13. The fender system of claim 4, wherein, in order to stow the fender body, the fender body is moved so as to:

receive the fender interface portion of the connecting base in the insertion recess of the fender body; and insert the male connecting feature into the interface aperture of the fender interface portion.

14. A fender system for a watercraft, comprising:

a fender body defining an insertion recess in a peripheral surface of the fender body;

a first connecting feature disposed at least in part in the insertion recess of the fender body; and a connecting base configured to be connected to the watercraft, the connecting base comprising a second connecting feature, the first connecting feature being configured to engage the second connecting feature for stowing the fender body on the watercraft; and a rope tied to the connecting base and to the fender body so as to attach the fender body to the connecting base when the fender body is deployed on a side of the watercraft.

15. The fender system of claim 11, wherein:

an upper end of the fender body defines a retaining aperture extending downwardly from the upper end;

the retaining aperture extends from the upper end to the upper wall from which the first connecting feature extends downwardly; and the interlocking member comprises a fender anchoring portion that is inserted into the retaining aperture to connect the interlocking member to the fender body.

16. The fender system of claim 15, further comprising a retaining member inserted into the retaining aperture through the upper end of the fender body, the retaining member being configured to retain the fender anchoring portion of the interlocking member inserted into the retaining aperture.

17. A fender system for a watercraft, comprising:

a fender body defining an insertion recess in a peripheral surface of the fender body;

a first connecting feature disposed at least in part in the insertion recess of the fender body; and a connecting base configured to be connected to the watercraft, the connecting base comprising a second connecting feature, the first connecting feature being configured to engage the second connecting feature for stowing the fender body on the watercraft, the first connecting feature being disposed vertically higher than a center of gravity of the fender body when the first connecting feature engages the second connecting feature.

18. A watercraft, comprising:

a hull;

a deck connected to the hull;

a barrier structure at least partly surrounding the deck, the barrier structure comprising a rail configured for grabbing by a user; and the fender system of claim 5.

19. The watercraft of claim 18, wherein:

the rail has a cross-sectional profile having a similar shape as the attachment portion of the connecting base; and the attachment portion of the connecting base is configured to be clipped toollessly onto the rail of the watercraft, the attachment portion being sufficiently flexible to be elastically deformed when being clipped onto the rail.

20. A fender system for a watercraft, comprising:

a fender body defining an insertion recess in a peripheral surface of the fender body, the fender body being generally cylindrical, the peripheral surface being a curved surface extending between an upper end and a lower end; and a first connecting feature disposed at least in part in the insertion recess of the fender body, the first connecting feature being configured to engage a second connecting feature disposed on a part of the watercraft for stowing the fender body on the watercraft, the insertion recess being defined at least in part by an upper wall facing generally downwardly towards a lower end of the fender body when the first connecting feature engages the second connecting feature.

21. The fender system of claim 1, wherein the first connecting feature extends downwardly away from the upper wall when the first connecting feature engages the second connecting feature.

* * * * *